US011952848B2

(12) United States Patent
Jaaskelainen et al.

(10) Patent No.: US 11,952,848 B2
(45) Date of Patent: Apr. 9, 2024

(54) DOWNHOLE TOOL FOR DETECTING FEATURES IN A WELLBORE, A SYSTEM, AND A METHOD RELATING THERETO

(71) Applicant: Halliburton Energy Services, Inc., Houston, TX (US)

(72) Inventors: Mikko K. Jaaskelainen, Houston, TX (US); Ronald Glen Dusterhoft, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 27 days.

(21) Appl. No.: 17/850,438

(22) Filed: Jun. 27, 2022

(65) Prior Publication Data

US 2023/0417114 A1 Dec. 28, 2023

(51) Int. Cl.

| | |
|---|---|
| ***E21B 23/01*** | (2006.01) |
| ***E21B 23/06*** | (2006.01) |
| ***E21B 33/1295*** | (2006.01) |

(52) U.S. Cl.

CPC ..... *E21B 23/01* (2013.01); *E21B 23/06* (2013.01); *E21B 33/1295* (2013.01)

(58) Field of Classification Search

CPC ..... E21B 23/01; E21B 23/06; E21B 33/1295; E21B 47/101; E21B 21/08

See application file for complete search history.

(56) References Cited

U.S. PATENT DOCUMENTS

| | | | | |
|---|---|---|---|---|
| 5,029,816 | A | 7/1991 | Langston | |
| 5,182,779 | A | 1/1993 | D'Agostino et al. | |
| 7,404,416 | B2 * | 7/2008 | Schultz | F15C 1/22 239/589.1 |
| 8,789,585 | B2 | 7/2014 | Leising et al. | |
| 10,538,980 | B2 | 1/2020 | Jaaskelainen | |
| 10,550,654 | B2 | 2/2020 | Jaaskelainen | |
| 10,705,242 | B2 | 7/2020 | Jaaskelainen et al. | |
| 10,795,109 | B2 | 10/2020 | Benjamin et al. | |

(Continued)

FOREIGN PATENT DOCUMENTS

| | | | |
|---|---|---|---|
| WO | 2018118046 | A1 | 6/2013 |
| WO | 2018070980 | A1 | 4/2018 |

(Continued)

OTHER PUBLICATIONS

"Precision Wound Spools," Linden Photonics, Dec. 30, 2021, 3 pages, Linden Photonics, Inc.

(Continued)

*Primary Examiner* — Cathleen R Hutchins
*Assistant Examiner* — Ronald R Runyan
(74) *Attorney, Agent, or Firm* — Conley Rose, P.C.; Rodney B. Carroll

(57) ABSTRACT

A downhole tool having a downhole end and an uphole end, including: an anchor assembly positioned proximate to the downhole end; at least one flowmeter assembly selectively positionable from the downhole tool wherein the at least one flowmeter assembly includes a flowmeter having a throughbore generally aligned with an axis of the flowmeter; and a waveguide positioned proximate to the uphole end, wherein the at least one flowmeter assembly is positioned proximate to the anchor, wherein the waveguide extends through the throughbore and is secured at the anchor assembly.

22 Claims, 14 Drawing Sheets

(56) References Cited

U.S. PATENT DOCUMENTS

| | | | | |
|---|---|---|---|---|
| 11,131,185 | B1 | 9/2021 | Jaaskelainen et al. | |
| 11,168,543 | B2 | 11/2021 | Purkis | |
| 2005/0045343 | A1 | 3/2005 | Bixenman et al. | |
| 2006/0165344 | A1 | 6/2006 | Mendez et al. | |
| 2011/0100642 | A1* | 5/2011 | Cens | E21B 47/10 166/373 |
| 2012/0085531 | A1 | 4/2012 | Leising et al. | |
| 2013/0160995 | A1 | 6/2013 | Ocalan et al. | |
| 2014/0010671 | A1 | 1/2014 | Cryer et al. | |
| 2014/0260588 | A1* | 9/2014 | Jaaskelainen | E21B 47/135 73/152.32 |
| 2014/0291499 | A1 | 10/2014 | Mathieu et al. | |
| 2014/0318769 | A1 | 10/2014 | Walton et al. | |
| 2014/0374119 | A1 | 12/2014 | Dewars et al. | |
| 2015/0075783 | A1* | 3/2015 | Angman | E21B 33/12 166/308.1 |
| 2016/0003648 | A1 | 1/2016 | Barfoot et al. | |
| 2016/0153276 | A1 | 6/2016 | Park et al. | |
| 2016/0265345 | A1 | 9/2016 | In't Panhuis et al. | |
| 2017/0138179 | A1 | 5/2017 | Jaaskelainen et al. | |
| 2017/0205260 | A1* | 7/2017 | Jaaskelainen | G01H 9/004 |
| 2017/0241831 | A1* | 8/2017 | Jaaskelainen | G01N 29/14 |
| 2017/0342822 | A1 | 11/2017 | Wilson et al. | |
| 2018/0266240 | A1 | 9/2018 | Jaaskelainen et al. | |
| 2018/0328120 | A1 | 11/2018 | Therrien et al. | |
| 2021/0047896 | A1 | 2/2021 | Arabskyy et al. | |
| 2021/0238984 | A1 | 8/2021 | Maida, Jr. et al. | |
| 2021/0372213 | A1 | 12/2021 | Park et al. | |

FOREIGN PATENT DOCUMENTS

| | | | |
|---|---|---|---|
| WO | 2020102534 | A1 | 5/2020 |
| WO | 2022048885 | A1 | 3/2022 |

OTHER PUBLICATIONS

Filing Receipt, Specification and Drawings for U.S. Appl. No. 17/492,097, entitled "Distributed Acoustic Sensing Systems and Methods With Dynamic Gauge Lengths," filed Oct. 1, 2021, 68 pages.

Filing Receipt, Specification and Drawings for U.S. Appl. No. 17/667,108, entitled "Marine Animal Monitoring During Seismic Surveying Using Distributed Acoustic Sensing," filed Feb. 8, 2022, 36 pages.

Filing Receipt, Specification and Drawings for U.S. Appl. No. 17/873,933, entitled "Method and System for Detecting One or More Properties, Positioning, and Minimizing Tension of a Waveguide," filed Jul. 26, 2022, 61 pages.

Foreign Communication from Related Application—International Search Report and Written Opinion of the International Searching Authority, International Application No. PCT/US2022/035958, dated Mar. 24, 2023, 9 pages.

Foreign Communication from Related Application—International Search Report and Written Opinion of the International Searching Authority, International Application No. PCT/US2022/038756, dated Apr. 19, 2023, 11 pages.

Office Action dated Nov. 17, 2023 (23 pages), U.S. Appl. No. 17/873,933, filed Jul. 26, 2022.

* cited by examiner

DOWNHOLE TOOL FOR DETECTING FEATURES IN A WELLBORE, A SYSTEM, AND A METHOD RELATING THERETO

TECHNICAL FIELD

Embodiments of the disclosure are directed to a downhole tool for detecting features in a wellbore, a system and a method relating thereto. More particularly, embodiments of the disclosure are directed to deploying the downhole tool for interrogating a waveguide for collecting acoustic signals through the waveguide and signals from each of first and second flowmeter assemblies, and converting the signals to multiphase flow data.

BACKGROUND

Generally, no two reservoirs or even wells accessing a reservoir or a formation are identical. Properties, such as porosity, permeability, pore throat sizes, chemical composition, layers, faults, depths, temperatures, pressures, and other attributes all depend on how the reservoir was formed over time and can vary with location.

Reservoirs deplete over time. So, pressure, flow rates, gas-oil-water ratios, solution gas, gas-oil interface and oil-water interface movement, and flow regimes change as the fluid composition changes. Additionally, flow regime can change at different locations along the wellbore as the flow rate is different between, e.g., the toe of the well and the heel of the well etc.

Usually, drilling is not conducted in a perfectly straight line, as there are natural undulations during the drilling process, and/or directional drilling is used to target sweet spots in reservoir layers. Sometimes even different reservoir layers are present within the same well. As such it may be extremely difficult to fully model and replicate in-situ conditions.

Wells are often completed using different hardware (swellable packers, hydraulic set packers, inflow control devices (ICDs), inflow control valves (ICVs), one or more of perforated liners, slotted lines, limited entry liners, and the like). These different designs can impact flow properties and measured data.

Subsurface flowmeters are mainly deployed in high production rate wells as the cost of these systems are about one order of magnitude higher than, e.g., pressure and temperature gauges. Subsurface flowmeters combined with distributed fiber-optic sensing (DFOS) could significantly improve the accuracy of measuring distributed flow allocation along a wellbore. However, deploying these devices can be very costly, and thus, rarely would deployment be economically justified. Hence, there is a need for a cost-efficient deployment of DFOS combined with flowmeters for accurate flow allocation in wellbores.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
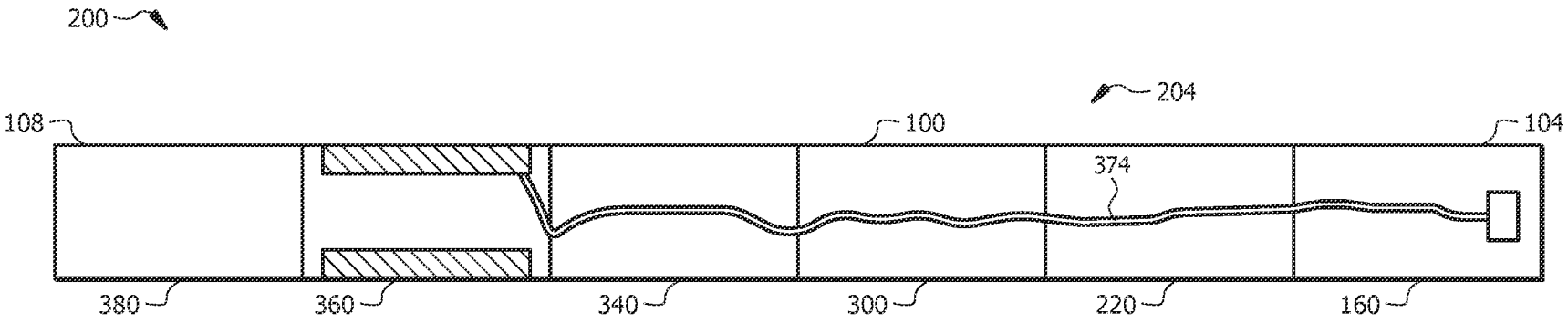
FIG. 1 illustrates an exemplary arrangement of a downhole tool in accordance with embodiments of the present disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Substantially similar or identical elements in the drawings may be identified by the same numeral to reduce redundancy.

As used herein, the term "vertical" can mean a direction orientated substantially perpendicular to the horizon or within about 20 degrees of perpendicular.

As used herein, term "horizontal" can mean a direction skewed from vertical in any direction, and may include a direction parallel to the horizon.

As used herein, the term "positioned", "positionable", or derivations thereof can include "deployed", "deployable", "retracted", "retractable", and derivations thereof.

As used herein, the term "deployed" can mean an object being moved downhole.

As used herein, the term "retracted" can mean an object being moved uphole, i.e., reverse deployment.

As used herein, the term "throughbore" can mean a hole of any suitable dimension extending through an object.

As used herein, the term "fluid path" can be a path formed by a wellbore and can be used for the production of fluids, such as hydrocarbons and water, or be used for the injection of fluids, such as water, carbon dioxide, and natural gas, e.g., methane.

As used herein, the term "coupled" can mean two items, directly or indirectly, joined, fastened, associated, connected, communicated, or formed integrally together either by chemical or mechanical means, by processes including extruding, stamping, molding, or welding. What is more, two items can be coupled by the use of a third component such as a mechanical fastener, e.g., a screw, a nail, a staple, or a rivet; an adhesive; or a solder.

As used herein, the term "and/or" can mean one or more of items in any combination in a list, such as "A and/or B" means "A, B, or the combination of A and B".

The present disclosure generally relates to deployment of a downhole tool including a waveguide, usually a fiber-optic cable, and at least one flowmeter. Usually, the downhole tool is deployed at the toe of a fluid production path, and one or more, usually a plurality of flowmeters, are retracted from the toe and anchored at different locations uphole from the toe along the fluid production path. The waveguide is anchored at the toe and passes therethrough each of the flow meters and communicates with the surface. Acoustic data collected from the waveguide and flowmeters can be converted to multiphase fluid flow data for ascertaining the fluid production from and/or injection into the fluid production path.

Knowing point and distributed flow allocation along wellbores can be highly desirable. Usually, current downhole flowmeters are expensive and require up-front investment in order to incorporate power and communications infrastructure required to support sub-surface flowmeters. Similarly, distributed fiber-optic sensing where the sensing cable is placed behind the casing during run-in-hole (RIH) often require upfront cost and in many cases increased due diligence and care before and during drilling and completion operations. Typically, operators commit to fairly significant upfront costs for sensing, in addition to the well construction cost, and thus this expense can limit deployment of subsurface sensing systems.

Operators often deploy subsurface sensing systems, and the most common sensing system is pressure and temperature (P/T) sensing systems or downhole pressure gauges. Both electrical and optical versions exist today. The advantage of optical pressure gauges is that the telemetry fiber can be used for distributed sensing or spare optical fibers can be added to the deployed cable. P/T gauges can provide valuable information but cannot provide flow rates.

In one example, fiber-optic sensing can used for various sensing applications in the oil and gas industry. Distributed fiber-optic sensing (DFOS) may use, e.g., distributed acoustic sensing (DAS) and/or distributed temperature sensing (DTS) and/or distributed strain sensing (DSS) optionally with a point P/T gauge that may be used to model flow distributions along wellbores, but cannot, in many cases, provide a unique flow distribution due to the highly complex subsurface environment where a number of potential solutions can match the measured data. In some embodiments, there are several ways to deploy fiber-optic sensors, including tubing conveyed cables or retrievable sensing cables like wireline and slickline, or cables deployed inside coiled tubing. Fiber-optic cables may also be deployed in wells using gravity where a weight or conveyance vehicle is dropped into a wellbore and fiber is released in the well as deployment vehicle moves down the wellbore. The optical fiber may be payed out from the surface or from a coil in the deployment vehicle. Gravity based deployment vehicles exist, and may be pumped into horizontal wellbores in some instances.

The present disclosure may include deploying sub-surface flowmeters and DFOS on demand after the well has been completed. One advantage can be any sensing related cost may be delayed with better capital allocation for operators and selected wells can be based on requirements that may arise over time.

The present disclosure can utilize disposable fibers, such as a fiber sold under the trade designation ExpressFiber and flowmeter technology from Haliburton Company of Houston, Texas. The fiber may be deployed using gravity in the vertical section and then pumped into the horizontal section of a wellbore. In any embodiment, the fiber may be deployed in the reverse direction, i.e., retract the fiber coil from the toe of the well and release fiber as the coil is pulled out of the wellbore.

The flowmeters can similarly be deployed to the toe of the wellbore in the same assembly as the fiber coil, and then can be retracted to selected locations as the assembly is being pulled out of the wellbore. The flowmeter assembly can form a void for the optical fiber to pass through each of the flowmeters. The void may be centered or offset, independently, in the each of the flowmeters. Generally, the flowmeters may each have a throughbore generally aligned with an axis to collectively form the wellbore assembly void.

In some embodiments, fluidic oscillators of each flowmeter in the flowmeter assembly may generate a frequency that is proportional to the flow through the flowmeter assembly. The frequency of oscillation can be a linear function of the flow rate, or equivalently the frequency can depend on the square-root of the pressure drop.

A downhole tool or string of assembled flowmeters can be deployed with a coil, tractored, or pumped into a fluid flow path depending on the completion. A conveyor may have a housing enclosing a tractor, and an optical fiber can pass through the throughbore of the flowmeters of the assembly where the optical fiber from the optical fiber coil can be attached to the anchor assembly. Thus, the string of assembled flowmeters may be retracted with a coil, cable and wire, or tractor to place each flowmeter at a different location uphole of the toe.

After deploying the downhole tool at the toe of the well, the anchor assembly may be activated or set to anchor the downhole tool in the fluid path. The string of flowmeters can then be pulled out or retracted to the first location where the first flowmeter assembly is anchored and the remaining flowmeter assemblies and a coil are released. The remaining flowmeter assemblies can then be deployed uphole and the string can continue to be retracted where the optical fiber can be coupled to the anchor assembly and located in the throughbores of each of the flowmeters. In some embodiments, the fiber can be deployed along the full length of the wellbore and passing thru all of the flowmeters. This deployment can allow DFOS with localized flow monitoring at selected locations along the fluid production path.

The flowmeters may be released using, e.g., some variation of a burst disc assembly so each burst disc assembly would have a unique release pressure where the pressure could be controlled from the surface. As an example, each string may include an actuator where burst disc in the actuator assembly below can be at a toe. An anchor device at the toe can be released first, and then selective release of respective anchors of the flowmeters as the remaining flowmeters can be retracted toward the surface. In some embodiments, the downhole tool may also be deployed with other mechanisms, such as a ball drop or an electrical motor, desirably to accommodate the fiber-optic fiber in the throughbore of each flowmeter.

The optical fiber may be interrogated using a DAS system during deployment where various downhole events may be measured, events, e.g., a disc bursting with associated noise profile. The flowmeters may have orientation sensors, e.g., accelerometers, to enable orientation measurements where the measured orientation can be acoustically transmitted where the optical fiber acts as a monitoring device interrogated by the DAS system.

Additional features and advantages of the disclosed embodiments will be or will become apparent to one of ordinary skill in the art upon examination of the following figures and detailed description. It is intended that all such additional features and advantages be included within the scope of the disclosed embodiments. Further, the illustrated FIGS. 1-18 are only exemplary and are not intended to assert or imply any limitation with regard to the environment, architecture, design, or process in which different embodiments may be implemented.

Referring to FIG. 1, a downhole tool 100 can have a downhole end 104 and an uphole end 108 and include an anchor assembly 160, at least one flowmeter assembly 200, typically a plurality of flowmeter assemblies 204, optionally a coil 360, and optionally a conveyor 380. The anchor assembly 160 can be proximate or adjacent to the downhole end 104, the at least one flowmeter assembly 200 may be proximate or adjacent to the anchor assembly 160, the at least one flowmeter assembly 200 may be proximate or adjacent to the coil 360, and the coil 360 may be proximate or adjacent to the conveyor 380. Each flowmeter assembly of the at least one flowmeter assembly 200 may be proximate or adjacent to at least one other flowmeter assembly. The at least one flowmeter assembly 200, which can be a plurality 204 as discussed below, can have individual flowmeters positionable at different locations, usually a fluid path. The downhole tool 100 can be deployed in a subterranean formation, which can have various formation fractures for producing fluids, such as oil and gas and typically less desirably water.

The anchor assembly 160 can be positioned at the downhole end 104. Once the downhole tool 100 is positioned at, e.g., the toe of a fluid path, the anchor assembly 160 can activate to fix the downhole tool 100. Any suitable device can be used to fix the downhole tool 100, so the anchor assembly 160 can include a swellable packer or an actuator, serving as an anchor. The anchor assembly 160 can be activated by raising the pressure at the surface with any suitable fluid displacement device, such as a pump. Raising the pressure within the fluid product path can activate the anchor assembly 160 to fix the downhole tool 100 at the toe, as discussed in further detail below.

The at least one flowmeter assembly 200 can include any suitable number of flowmeter assemblies. In some embodiments, the at least one flowmeter assembly 200 can include two or less or four or more, or such as three flowmeter assemblies, namely a first flowmeter assembly 220, a second flowmeter assembly 300, and a third flowmeter assembly 340, as depicted in FIG. 1.

Figure 2:
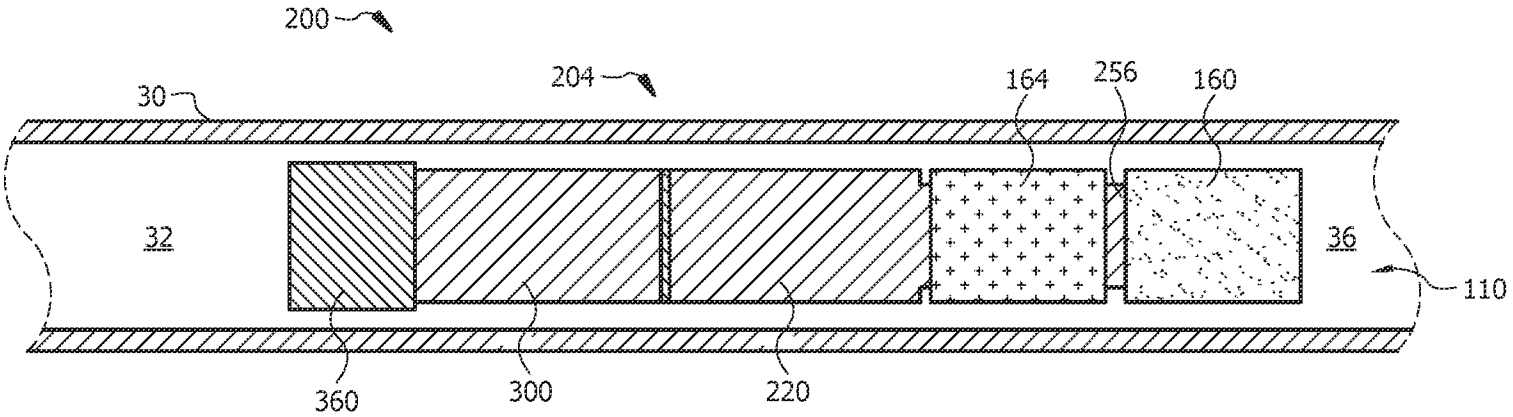
FIG. 2 illustrates another exemplary arrangement of a downhole tool in a fluid production path.
Figure 3:
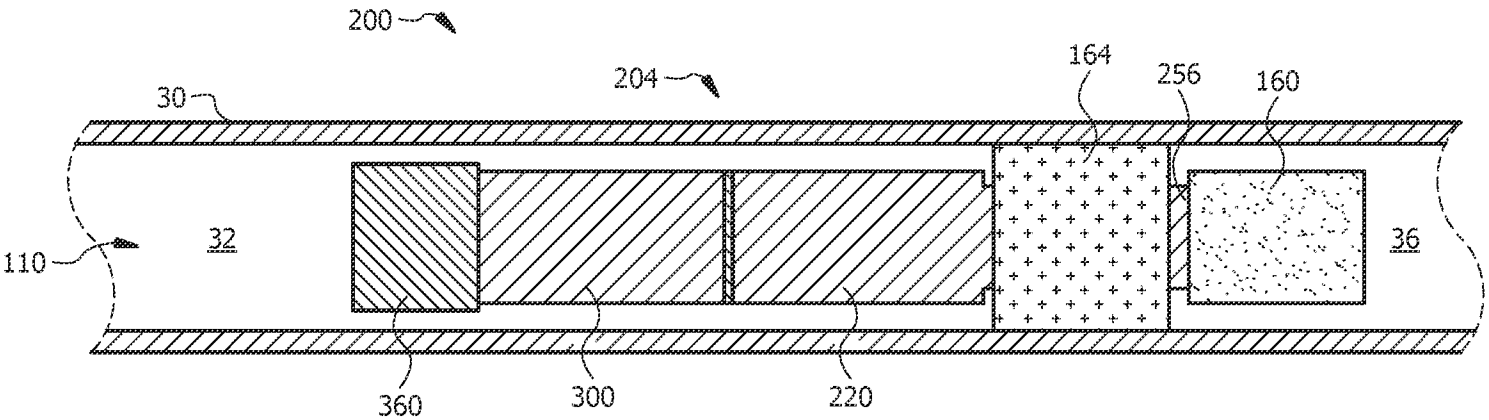
FIG. 3 illustrates the another exemplary arrangement of the downhole tool in the fluid production path with the swellable packer activated.

Referring to FIGS. 2-3, another exemplary arrangement of a downhole tool 110 for deployment in a fluid path 32 within a subterranean formation. The downhole tool 110 can include at least one flowmeter assembly 200, namely a plurality of flowmeter assemblies 204, particularly two flowmeter assemblies, namely a first flowmeter assembly 220 and a second flowmeter assembly 300. The downhole tool 110 can be positioned in the fluid path 32 using any suitable manner, as discussed below, at a toe 36 of the fluid path 32. A mechanical coupling or link may be provided between the casing, forming a generally cylindrical wall and defining the fluid flow path 32, and the formation (e.g., by filling with settable cementitious material, such as concrete, the annular cavity between the outer diameter of the casing and the co-axial borehole wall, and allowing the material to set).

Optionally, a seal 256 can couple the at least one flowmeter assembly 200 with the anchor assembly 160. A swellable packer 164, which can be unactivated, may be coupled to the seal 256. Referring to FIG. 3, the swellable packer 164 may swell reducing fluid flow around the downhole tool 110 and direct fluid flow through the at least one flowmeter meter assembly 200, as discussed further below, if fluid flow is present at the toe 36. In any embodiment, the swellable packer 164 can also fix or anchor the downhole tool in the fluid path 32 at the toe 36. Additionally, in any embodiment, the at least one flowmeter assembly 200 can include one or more swellable packers 164 proximately downhole to each flowmeter assembly 220 and 300 to prevent fluid flow between the at least one flowmeter assembly 200 and the wellbore 30, thereby directing fluid flow through each flowmeter of the at least one flowmeter assembly 200.

Figure 4:
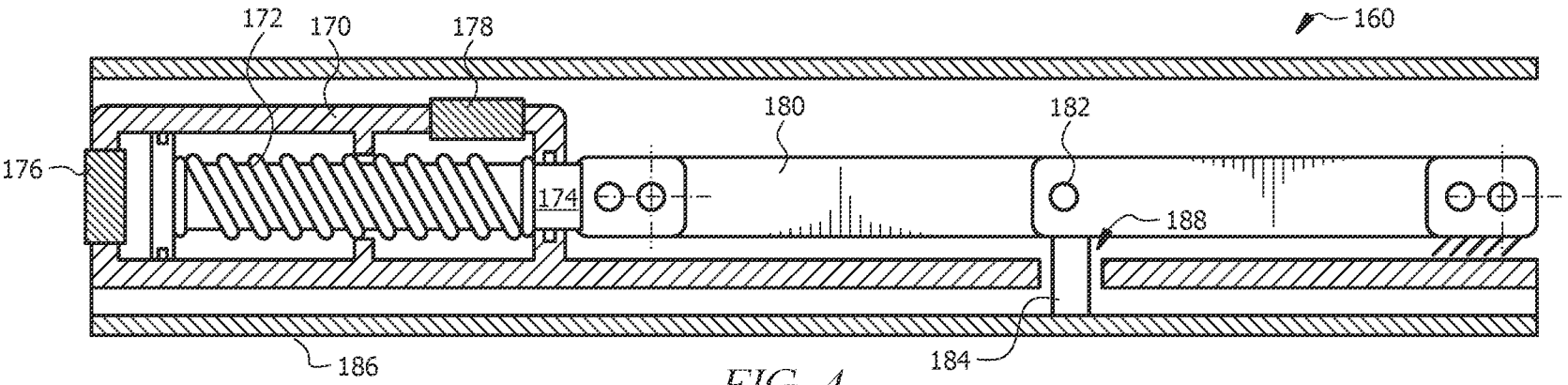
FIG. 4 illustrates a partial cross-section of an unactivated actuator of an anchor assembly.
Figure 5:
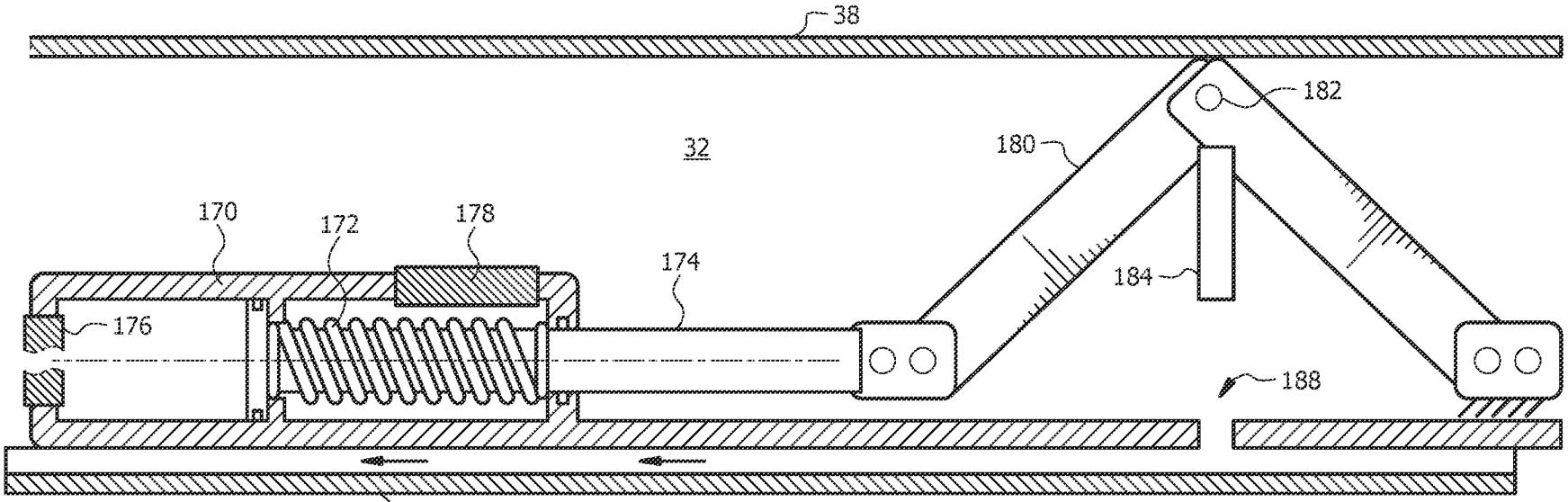
FIG. 5 illustrates a partial cross-section of an activated actuator of the anchor assembly.

Referring to FIGS. 4-5, an actuator 170 can include a spring 172, a rod 174, a first rupture disc 176, a second rupture disc 178, a linkage 180, a pivot point 182, and a pin 184. Note that the particular configuration as illustrated in FIGS. 4-5 is only one example of the actuator 170, and that the actuator 170 can in other instances be deployed in different configurations and in different subterranean cavities defined within the borehole or otherwise forming part of the wellbore.

Referring to FIG. 4, the actuator 170 is shown in an unactivated position with the rod 174 and the linkage 180 aligned. The linkage 180 in this example has two link members consisting of rigid elongated metal bars coupled at a pivot point 182. Typically, the actuator 170 is originally inserted unactivated into a borehole 624 and moved to a target position, such as a toe of a fluid path. Although the actuator 170 is described as being a part of the anchor assembly 160 of the downhole tool 100, the actuator 170 may also be used as a pressure activated release 260 for at least one flowmeter assembly 200, as hereinafter described. The pin 184 may be positioned within an aperture 188 formed by a sleeve 186 for securing other components, such as the at least one flowmeter assembly 200, to the anchor assembly 160.

Referring to FIG. 5, the anchor assembly 160 can be positioned within a fluid path 32 between a wellbore casing and a cylindrical wall 38 of a borehole. The actuator 170 is shown in an activated or a locked position by, e.g., raising the pressure to or exceeding a trigger pressure within the fluid path 32 with, e.g., a pump, to burst the first rupture disc 176 to allow fluid to compress the spring 172 resulting in a hydraulically actuated axial displacement of the rod 174 compressing the link 180. It will be appreciated that the radial lodging forces (which result in frictional resistance to axial displacement of the anchor assembly 160) is caused by hydraulic displacement of the rod 174 through hydraulic action of the ambient drilling fluid in the fluid path 32. The linkage 180 can be bent lifting the pin 184 from the aperture 188 in the sleeve 186. The removal of the pin 184 allows one or more components, such as the at least one flowmeter assembly 200 and the coil 360 to be separated from the anchor assembly 160 and moved uphole. The linkage 180 of the anchor assembly 160 can bear against the cylindrical wall 38, and thus serve as an anchor. Axial displacement of the anchor assembly 160 along the annular cavity can be resisted by axially acting friction caused by the radial contact or bracing force exerted via the upper portion of the linkage 180 and the base of the anchor assembly 160 against the cylindrical wall 38. Typically, the cylindrical wall 38 may be a casing cemented in place to form a good mechanical coupling to the formation. In this manner, the anchor assembly 160 can be secured or anchored in position.

Optionally, a deactivated or retracted condition can cause the linkage 180 to straighten back to an unactivated position. The mechanical linkage 180 which is, at one end thereof, pivotally connected to the rod 174 of the actuator 100. Moving the rod 174 inwardly can retract the linkage 180 from the cylindrical wall 38 and may allow movement or retrieval of the of the anchor assembly 160 from the formation. Specifically, in any embodiment, release or retraction of the anchor assembly 160 can selectively be affected by an operator increasing pressure of the ambient fluid to a level at or greater than the burst pressure of the second burst disc 178. Exposure of the actuator 170 to the higher pressure, in this example, can rupture the second burst disc 178 causing retraction of the rod 174 into the housing by equalizing the pressure therein and under the urging of the spring 172, resulting in displacement of the rod 174 inwardly. The linkage 180 is thus retracted from the cylindrical wall 38, so that the top of the linkage 180 no longer bears against the cylindrical wall 38. The actuator 170 is thus unlocked, being disposed into a retracted or deactivated condition (see, for example, FIG. 4), which can allow movement of the anchor assembly 160 along the fluid flow production path 32. Similarly, the pressure activated release 260 of the at least one flowmeter assembly 200 may be unlocked if activated to allow retrieval of the at least one flowmeter assembly.

Figure 6:
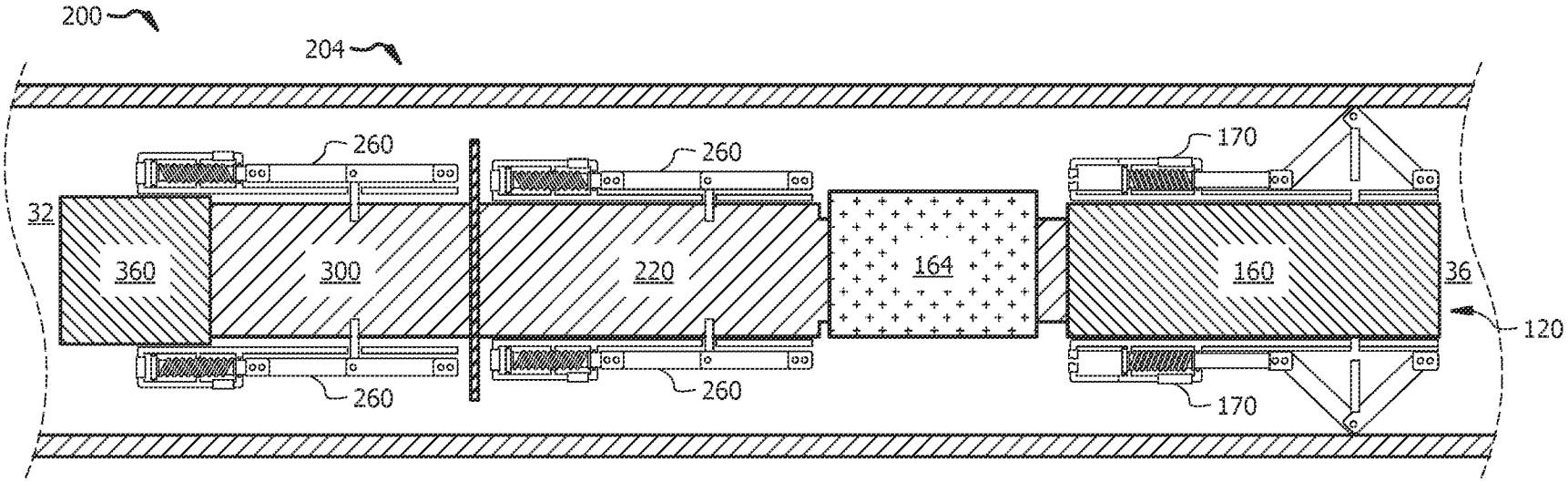
FIG. 6 illustrates a further exemplary arrangement of a downhole tool in a fluid production path with the actuator activated.
Figure 7:
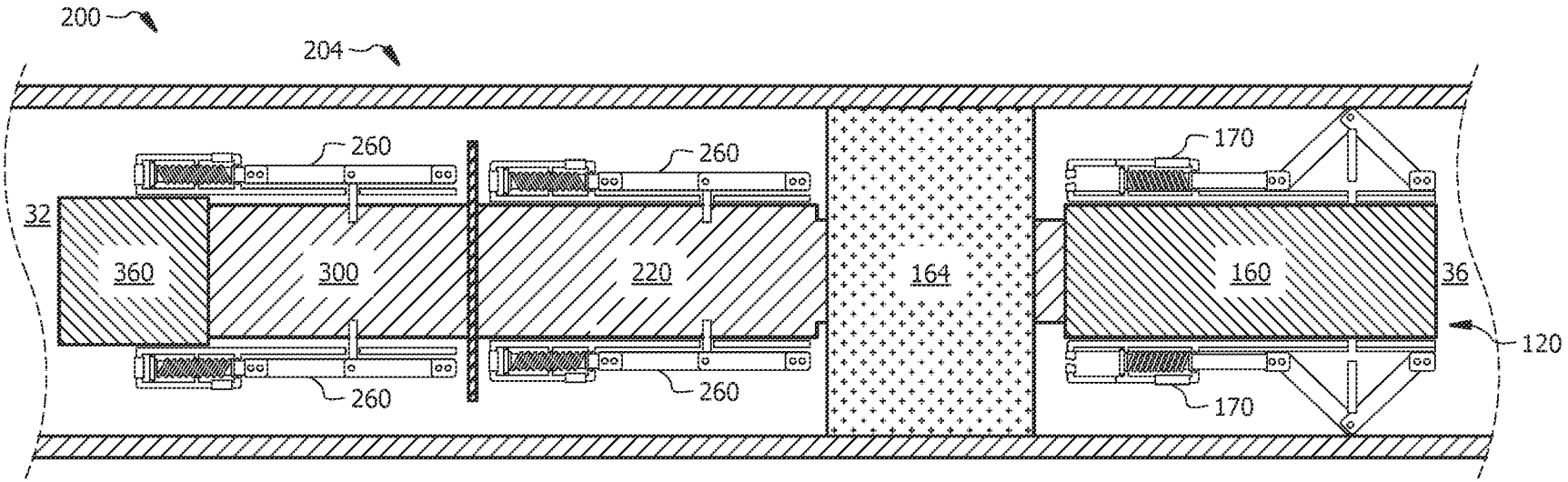
FIG. 7 illustrates the further exemplary arrangement of the downhole tool in the fluid production path with the actuator and swellable packer activated.

Referring to FIGS. 6 and 7, a further exemplary arrangement of a downhole tool 120 can be deployed at the toe 36 of the fluid path 32. In some exemplary embodiments, the downhole tool 120 can include the anchor assembly 160, the at least one flowmeter assembly 200, typically a plurality of flowmeter assemblies 204, and the coil 360, similarly, as described above in FIGS. 2 and 3, the downhole tool 110. In addition, the at least one flowmeter assembly 200 can include a first flowmeter assembly 220 and a second flowmeter assembly 300.

The downhole tool 120 can be positioned at the toe of the fluid path 32. The anchor assembly 160 can include two actuators 170 positioned at opposing sides of the anchor assembly 160, such as at the top and bottom. Activating the actuators 170, can secure the anchor assembly 160, as described above, in the fluid path 32. The lifting of the pins of the actuators uncouples a sleeve permitting the separation of the at least one flowmeter assembly 200 and the coil 360 (optionally a conveyor 380 if present) from the anchor assembly 160. In addition, the swellable packer 164 can swell further securing the downhole tool 120 and blocking fluid flow around the downhole tool 110 to direct flow through a flowmeter of the at least one flowmeter assembly 200, provided fluid flows into the fluid flow path 32 at the toe 36. In any embodiment, additional swellable packers 164 can be provided proximately downhole of each flowmeter assembly 220 and 300 for directing fluid flow therethrough. The pressure activated releases 260 can be unactivated to permit moving the at least one flowmeter assembly 200 uphole for locating the first flowmeter assembly 220 and the second flowmeter assembly 300 at different locations, as discussed further below.

Figure 8:
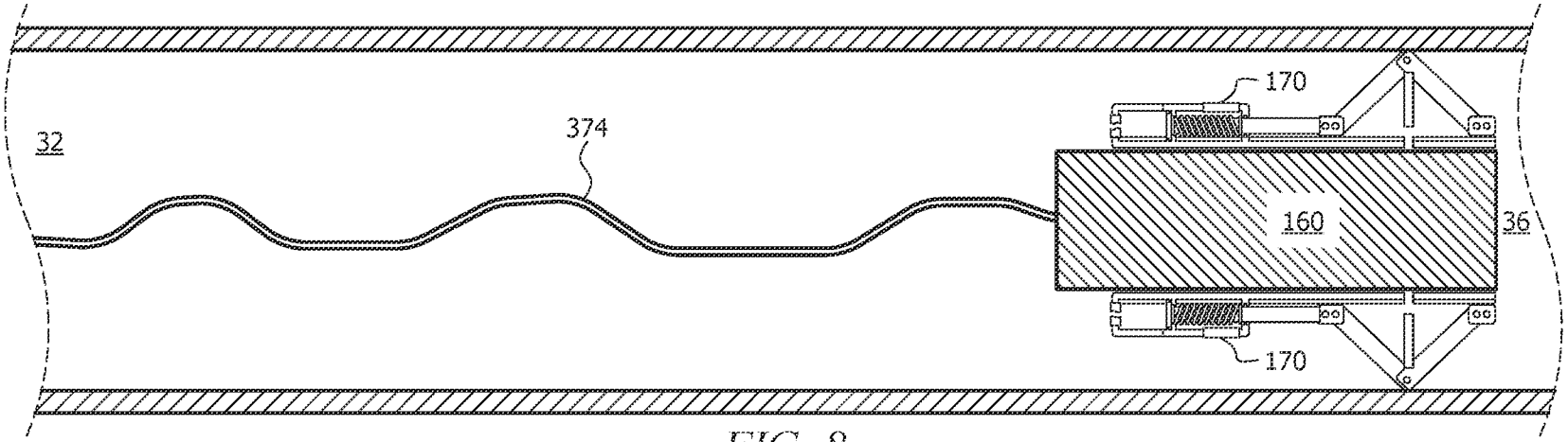
FIG. 8 illustrates an anchor assembly of the further exemplary arrangement of the downhole tool with the actuator activated.

Referring to FIGS. 8-12, different embodiments of securing an anchor assembly 160 to the fluid flow path 32 are depicted. As depicted in FIG. 8, the anchor assembly 160 can be secured at the toe 36 of the fluid flow path 32 with the actuators 170, similarly as described above. The other portions of the downhole tool 100, such as the at least one flowmeter assembly 200 and coil 360, can separate and be located uphole and be coupled to the anchor assembly 160 via the waveguide 374. Eventually, the coil 360 can separate from the flowmeter assembly furthest uphole and be retrieved at the surface.

Figure 9:
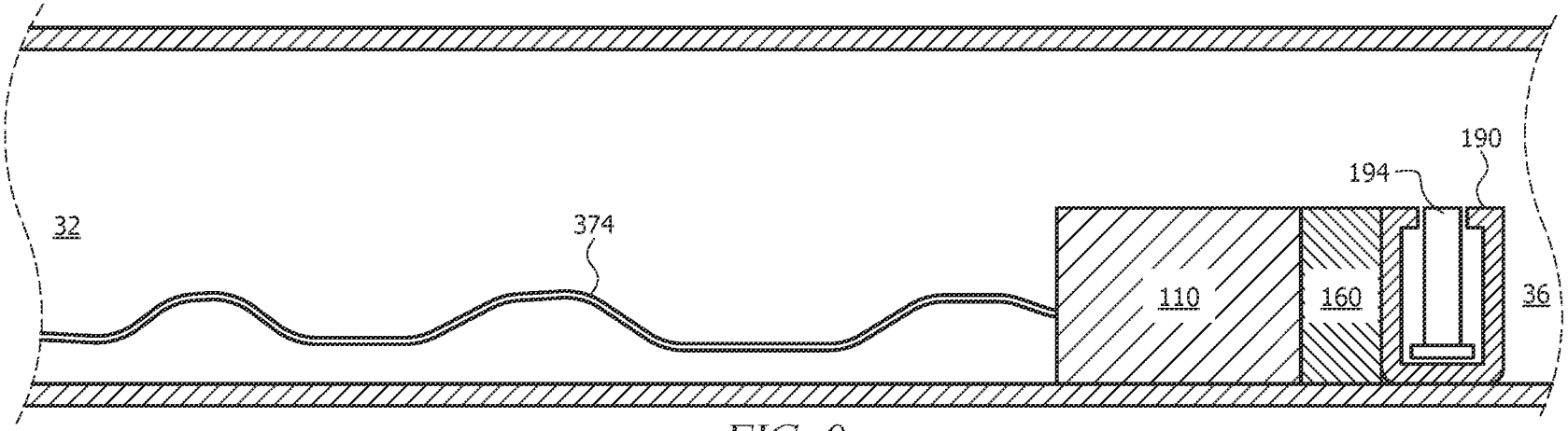
FIG. 9 illustrates another anchor assembly with another actuator in a fluid production path with the actuator unactivated.
Figure 10:
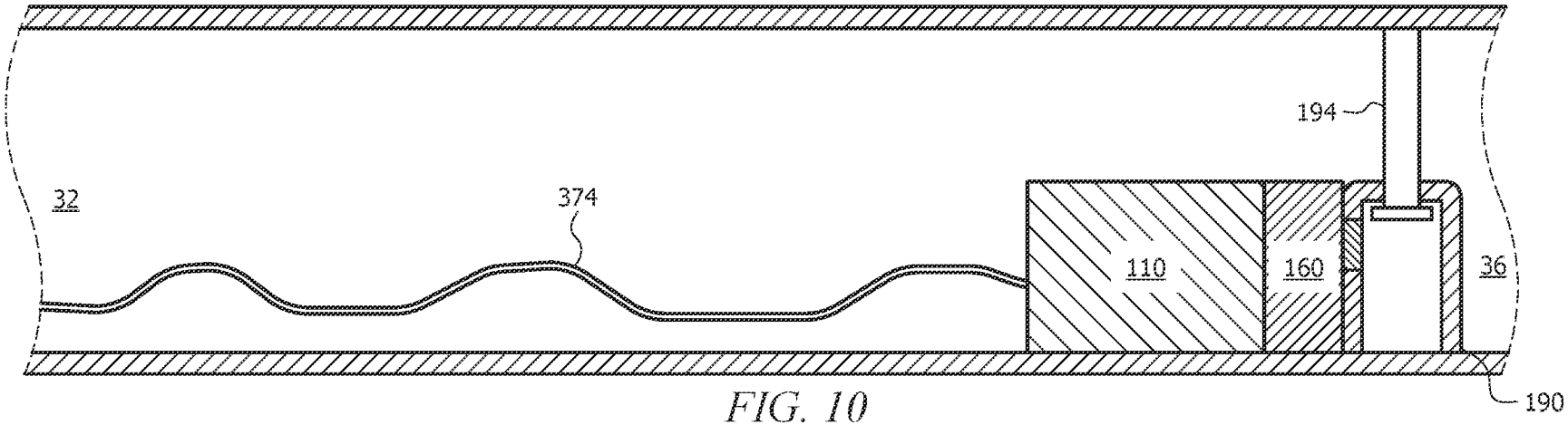
FIG. 10 illustrates another anchor assembly with another actuator in a fluid production path with the actuator activated.

Referring to FIGS. 9-10, the anchor assembly 160 of the downhole tool 110 can include another actuator 190, instead of the actuator 170, for securing the anchor assembly 160. The actuator 190 can include a rupture disc 192 and a plunger 194. When the trigger pressure exceeds the rupture disc 192 tolerance, the rupture disc 192 bursts allowing fluid therein to drive the plunger 194 upwards against the cylindrical wall 38, thereby securing the anchor assembly 160. Generally, once the plunger 194 extends upward, the plunger 194 remains in place securing the anchor assembly 160 in the fluid path 32.

Figure 11:
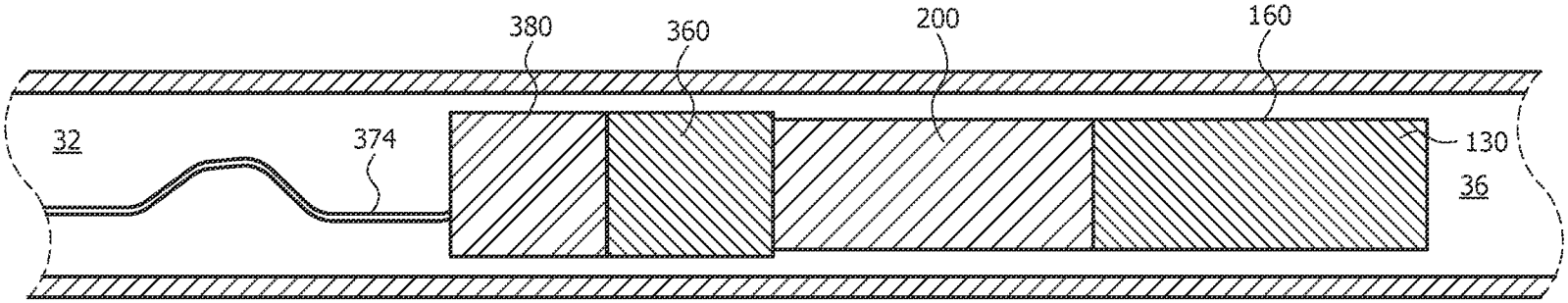
FIG. 11 illustrates yet another exemplary arrangement of a downhole tool being deployed in a fluid production path.
Figure 12:
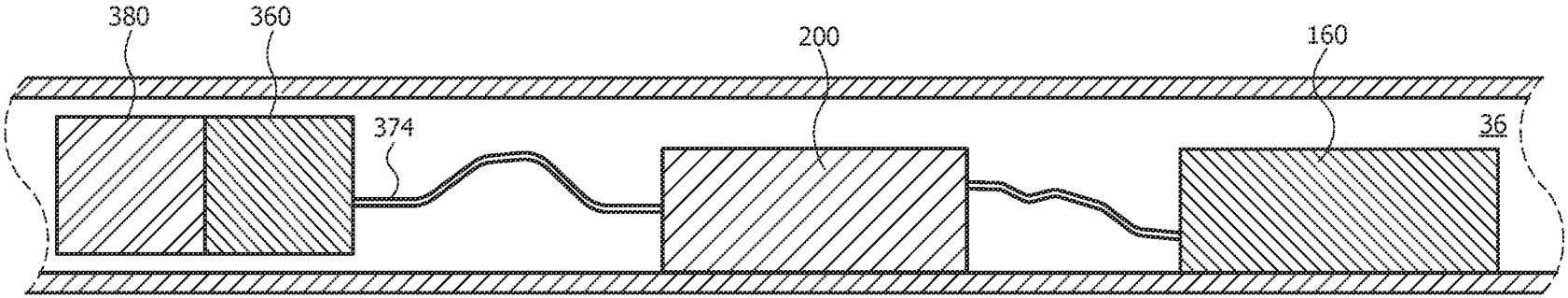
FIG. 12 illustrates yet another exemplary arrangement of the downhole tool with an anchor assembly fixed and at least one flowmeter assembly and coil being retracted.
Figure 13:
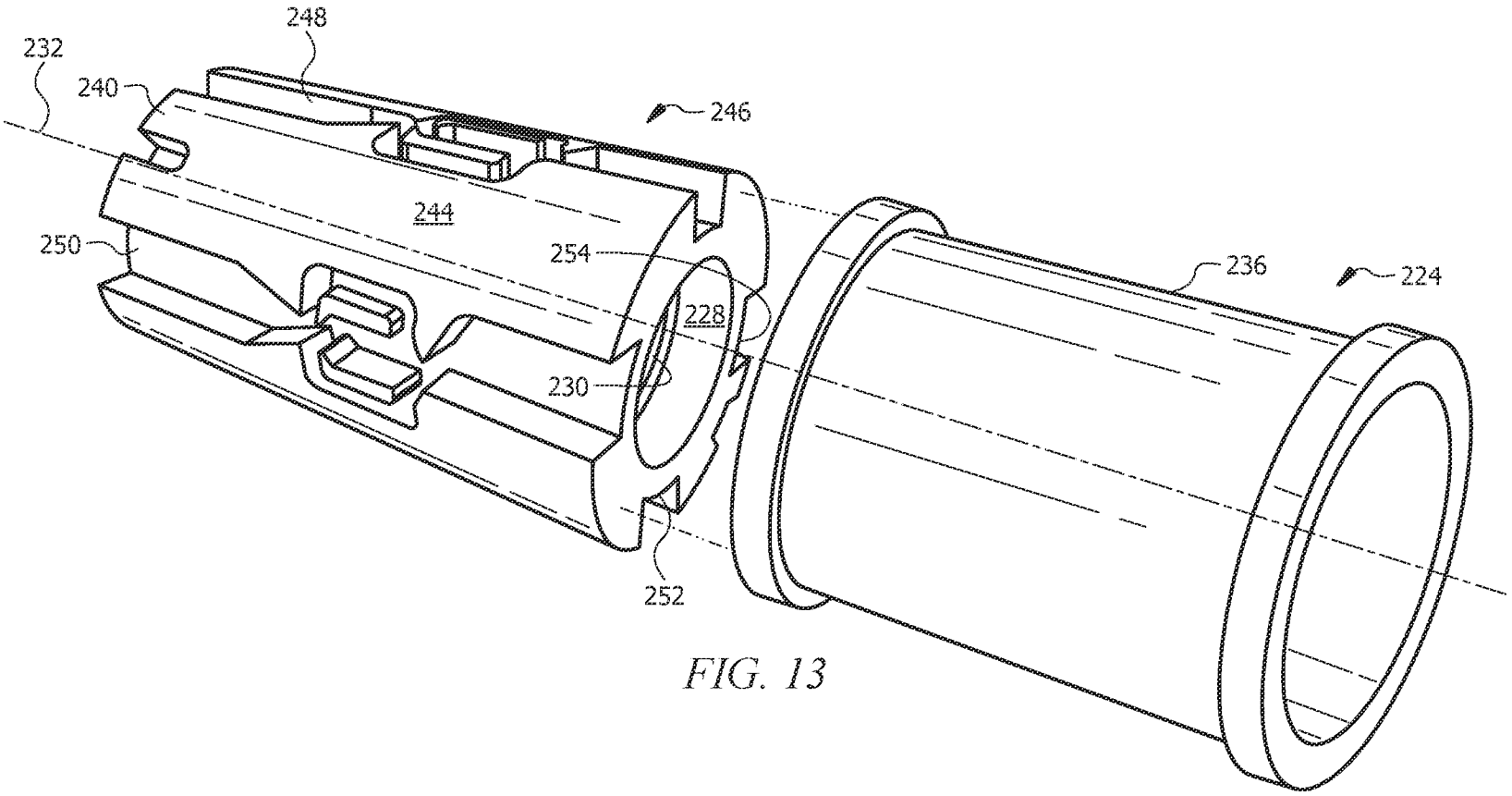
FIG. 13 illustrates as an exploded view an exemplary arrangement of a flowmeter with an outer housing and an inner housing of the first flowmeter assembly in accordance with any embodiment.

Referring to FIGS. 11-12, another example of a downhole tool 130 can be positioned and secured in the fluid path 32, and can be similar to the downhole tool 110. In this example, the downhole tool 130 can be pumped or positioned to the desired location in the fluid path 32, such as the toe 36. After locating the downhole tool 130, the anchor assembly 160 can have sufficient weight or ballast to settle on the floor of the fluid path 32. The waveguide 374 can have sufficient strength, e.g., be surrounded with a supporting sheath to allow the at least one flowmeter assembly 200 and coil 360 to be withdrawn and separate from the anchor assembly 160 and be unconnected at the surface 12. In this example, the anchor assembly 160 has a weight exceeding the force required to separate the at least one flowmeter assembly 200 and coil 360 from the anchor assembly 160 so the anchor assembly 160 remains in place as the other components separate. In any embodiment, the separable components can have more force to separate proceeding uphole along the downhole tool 130. Optionally, a conveyor 380 can be provided in some embodiments to retract the at least one flowmeter assembly 200. In any embodiment, the conveyor 380 can separate the coil 360 from the at least one flowmeter assembly 200, as again, the weight of the at least one flowmeter assembly 200 exceeds the force to separate and the conveyor 380 and the coil 360 return to the surface while the at least one flowmeter assembly 200 settles to the bottom of the wellbore.

In some embodiments the flowmeter assemblies may be, independently, different. However, each flowmeter assembly may be substantially identical, so only the flowmeter assembly 220 will be described in detail with respect to FIGS. 1 and 13. The first flowmeter assembly 220 can include any suitable flowmeter, such as a flowmeter 224 having an outer housing 236 and an inner cylinder 240. The flowmeter 224 may form a throughbore 228 defining a chamber 230 therein generally aligned with an axis 232, which may be centrally coaxial. In some embodiments, the outer housing 236 may have a swellable packer 164, as described above, coupled thereto to restrict flow around the flowmeter assembly 220 and direct fluid flow through the inner cylinder 240, and in some embodiments, to serve as an anchor. The outer housing 236 may receive the inner cylinder 240 therein. The inner cylinder 240 can include an outer surface 244 forming one or more oscillation grooves 246, including a first oscillation groove 248, a second oscillation groove 250, a third oscillation groove 252, and a fourth oscillation groove 254.

In this example, the flowmeter 224 may be a fluidic oscillator. Generally, a fluidic oscillator can have no moving parts and may spray a fluid from side to side therein. A fluid jet can enter the throughbore 228 with, e.g., two or more oscillation grooves, such as the first oscillation groove 248 and the third oscillation groove 252, acting as feedback channels. When the jet sweeps close to one side of the chamber 230, part of the fluid is directed along the feedback channel and back toward the inlet. That flow feeds into a recirculating separation bubble in the middle of the chamber 230. As that bubble grows, it pushes the jet back toward the other feedback channel, continuing the cycle, and generating acoustic signals unique to a composition of fluid passing through the throughbore 228.

Referring back FIG. 1, the coil 360 can include an inventory of the waveguide 374 that is coupled at a downhole end to the anchor assembly 160 and when fully deployed, can be coupled at an uphole end at the surface. In some embodiments, the waveguide 374 may be a fiber-optic sensing cable, telecommunications cable, an electrical cable, an umbilical cable, a flowline cable, or an array of optical/electrical hydrophones. A fiber-optic cable may house one or several optical fibers and the optical fibers may be single mode fibers, multi-mode fibers or a combination of a single mode and multi-mode optical fibers. The fiber-optic sensing systems, discussed hereinafter, connected to the optical fibers may include DTS systems, DAS Systems, DSS Systems, quasi-distributed sensing systems where multiple single point sensors are distributed along an optical fiber or cable, or single point sensing systems where the sensors are located at the end of the cable.

Figure 14:
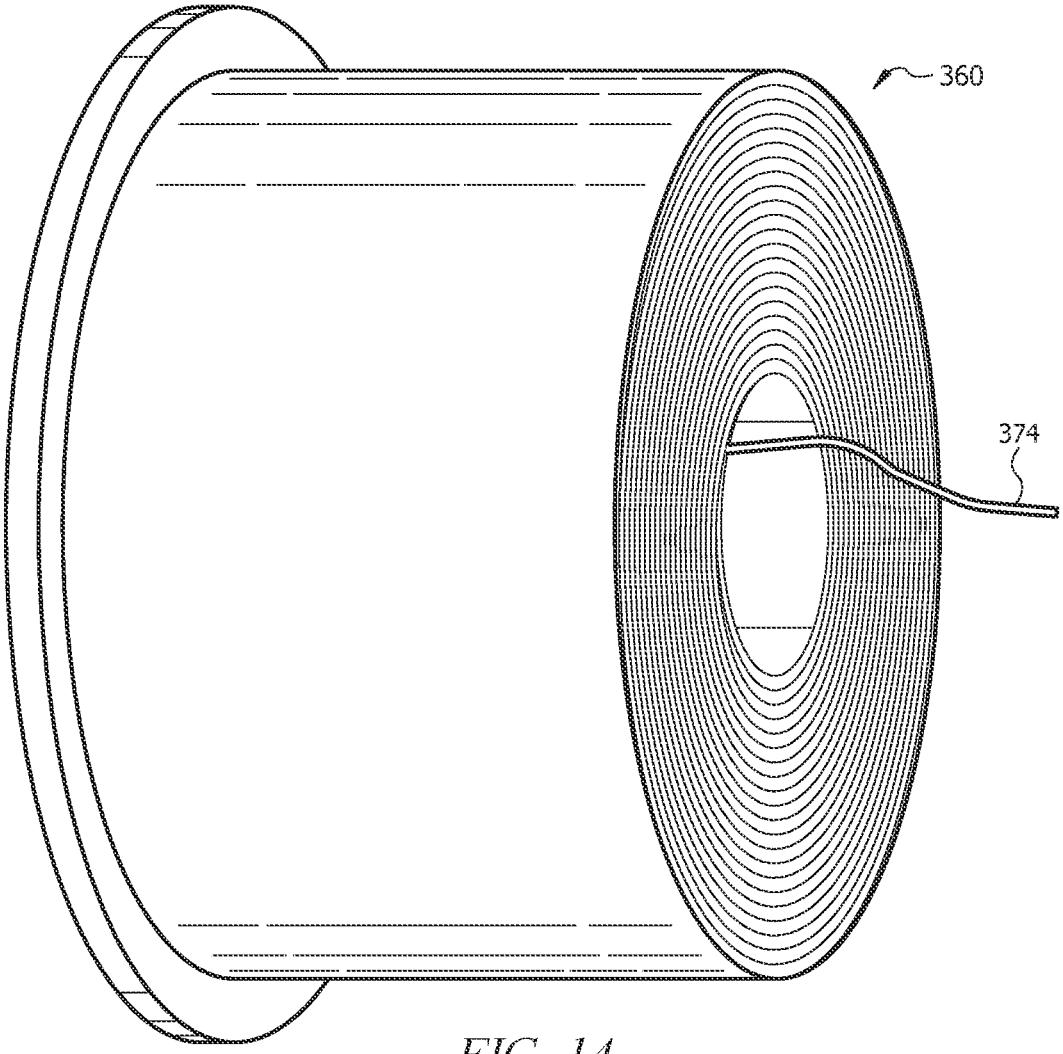
FIG. 14 illustrates a perspective view of an exemplary coil of a downhole tool in accordance with any embodiment.
Figure 15:
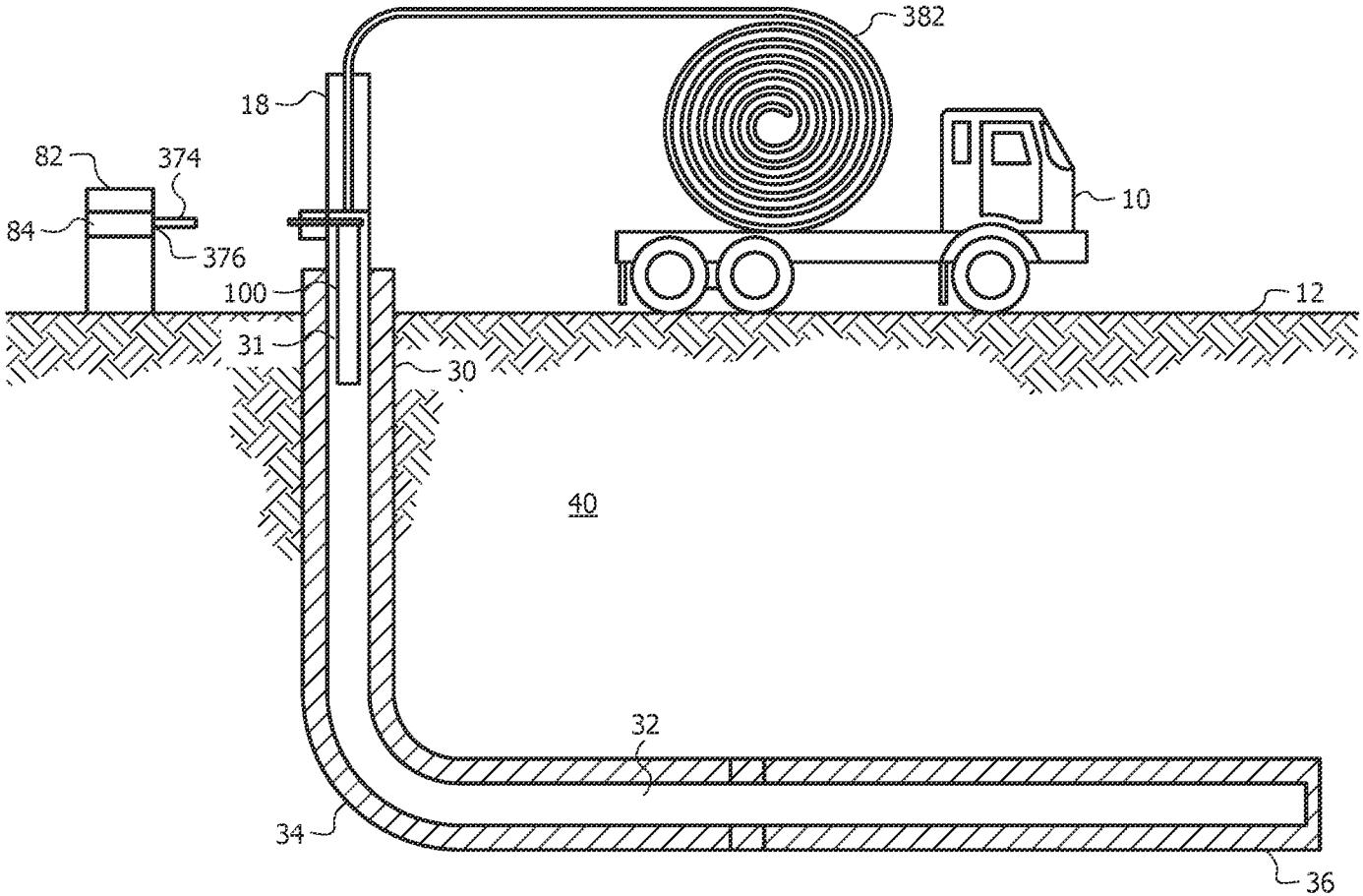
FIG. 15 illustrates an exemplary arrangement of a downhole tool in a first position of a wellbore in accordance with embodiments of the present disclosure.
Figure 16:
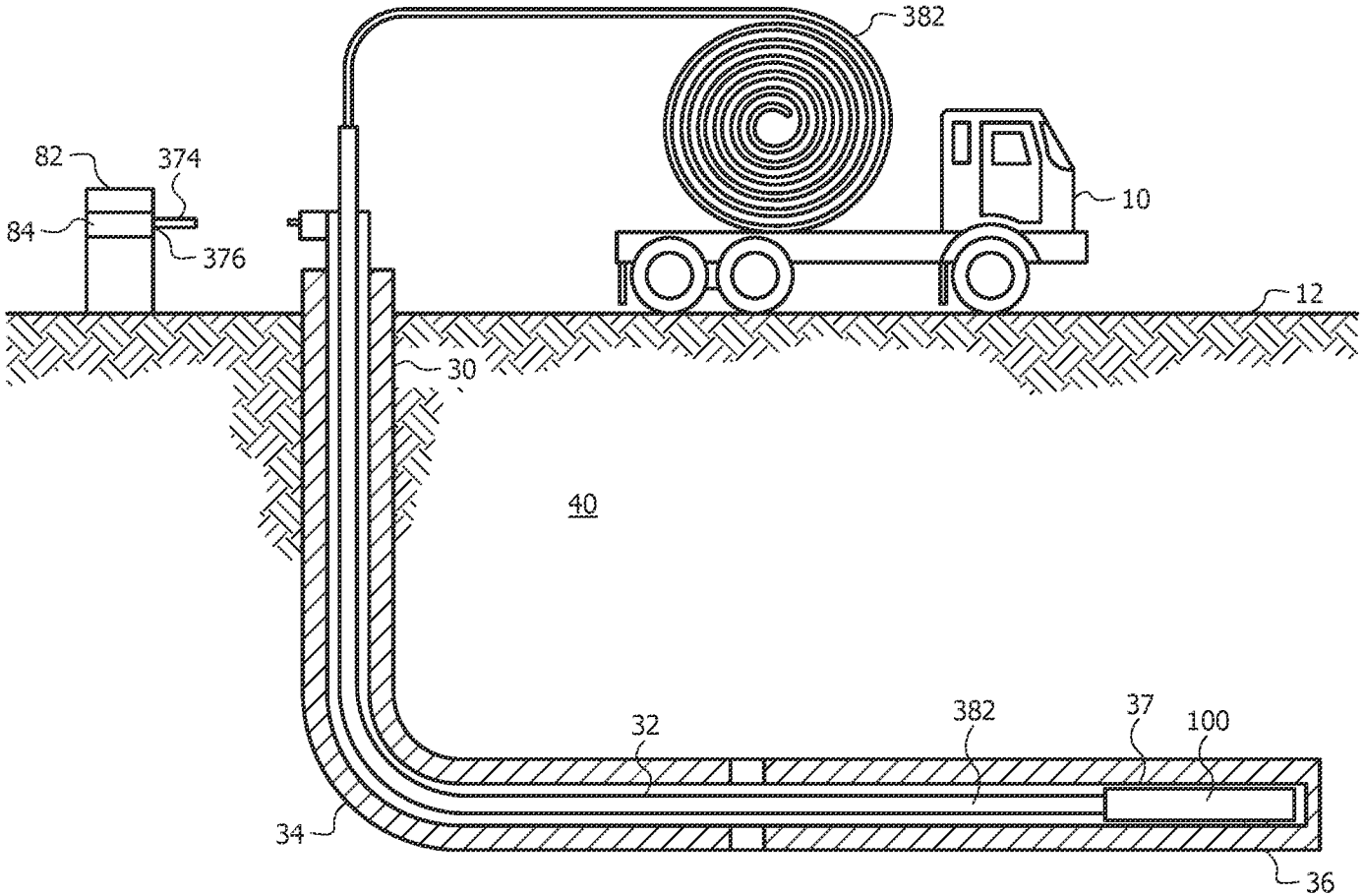
FIG. 16 illustrates an exemplary arrangement of a downhole tool deployed in a second position of a wellbore in accordance with embodiments of the present disclosure.
Figure 17:
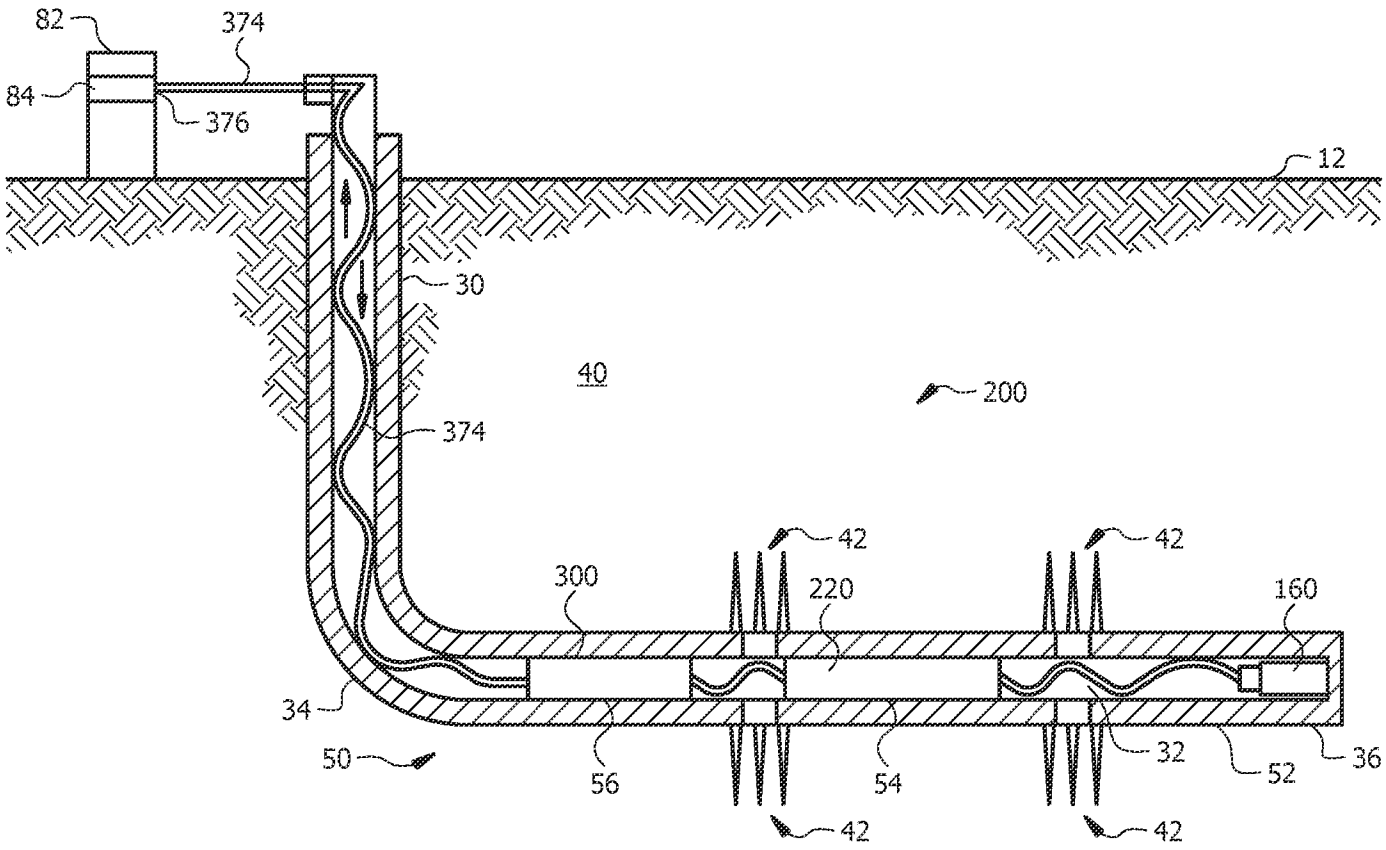
FIG. 17 illustrates an exemplary arrangement of a downhole tool with a plurality of flowmeters retracted in accordance with embodiments of the present disclosure.

The coil 360 can support a waveguide 374 either on a spool or from a self-contained roll of the waveguide 374 with an end removed from the center of the roll, as depicted in FIG. 14. In some embodiments, the coil 360 or a spool may be at the surface excluded from the downhole tool 100 as the downhole tool 100 is deployed to the toe 36, or the coil 360 or a spool with a roll of waveguide 374 thereon may be included with the downhole tool 100 while the downhole tool 100 is deployed to the toe 36. In any embodiment, the downhole tool 100 having a plurality of flowmeter assemblies 204 and the anchor assembly 160 with a waveguide 374 contained in the coil 360 can be connected to a panel 82 at the surface 12, as depicted in FIG. 15. In any embodiment, the downhole tool 100 can have the coil 360 where the waveguide 374 and the plurality of flowmeter assemblies 204 can be deployed as the downhole tool 100 travels downhole to reach the toe 36. In any embodiment, the downhole tool 100 having an optional conveyor 380 (or deploying and retracting the downhole tool 100 with, e.g., using coiled tubing), a coil 360, a plurality of flowmeter assemblies 204 and the anchor 160 can be deployed to the toe 36 with the waveguide 374 on the coil 360 unconnected at the surface 12. The plurality of flowmeter assemblies 204 and the waveguide 374 can reverse deploy as the conveyor 380 or coiled tubing 382 can withdraw the coil 360 to the surface 12, as depicted in FIGS. 15-17.

Turning back to FIG. 1, in any embodiment, the waveguide 374 can be secured at the anchor assembly 160 and is extended within and past the respective throughbore of each flowmeter of the at least one flowmeter assembly 200. An axis 232, generally aligned coaxial with the throughbore 228, passes longitudinally through the inner cylinder 240. The waveguide 374 can be coaxial with, e.g., the central axis 232 of the respective flowmeter 224, or offset. The flowmeter assembly 220 can be made from any suitable material. In any embodiment, the waveguide 374 can be deployed as the downhole tool 100 travels to the toe 36, and after the anchor assembly 160 is activated, is reversed deployed as the coil 360 and at least one flowmeter assembly 200 travels back uphole.

The waveguide 374 can be wound around a spool payable at an end. As an example, the waveguide 374 can be payed out at one end, as the downhole tool 100 deploys through the fluid path towards the toe, or after the activating the anchor assembly 160, pay out at the end as the coil 360 is retracted uphole.

In any embodiment, the coil 360 may omit the spool. In any embodiment, a coil 360 of waveguide 374 may be a single, self-contained roll. In any embodiment referring to FIGS. 1 and 14, the coil 360 may include the waveguide 374. In some embodiments, the waveguide 374 may deployed from the center of the coil 360 as the downhole tool 100 travels to the toe, or in some embodiments may be deployed from the center of the coil 360 as the coil 360 separates from the anchor assembly 160 and travels uphole.

In any embodiment, the conveyor 380 attached to the coil 360 may be omitted if a conveyor, e.g., a coiled tubing, can be provided external to the downhole tool 100 and used for deployment in the fluid path. In some embodiments, the conveyor 380 is included and may be a cable and wireline or a tractor. After the downhole tool 100 is deployed in the fluid path, the cable and wireline may connect the downhole tool 100 to the surface, and the cable and wireline can be retrieved pulling the undeployed waveguide 374 uphole to the surface. In some embodiments, the conveyor 380 may include a tractor that activates and retrieves the undeployed waveguide 374 from the coil 360 uphole to the surface after the anchor assembly 160 activates. As hereinafter described, if more than one flowmeter assembly is present, each flowmeter assembly can be anchored at a different location. In some embodiments, the conveyor 380 houses a cable and wireline coupled to the at least one flowmeter assembly 200, and as the cable and wireline are drawn towards the surface 12, the at least one flowmeter assembly 200 and coil 360 may be retracted toward the surface. In some embodiments, the conveyor 380 houses a tractor coupled to the at least one flowmeter assembly 200 and the tractor can retract or pull, e.g., the at least one flowmeter assembly 200 and the coil 360 toward the surface.

As discussed above, the downhole tool, such as the downhole tool 100, 110, 120, or 130, can be deployed in any suitable manner. In some embodiments, a coiled tubing 382 is used, as depicted in FIG. 15, for positioning the downhole tool 100 in a wellbore 30. The wellbore 30 can surround a fluid path 32 and have a heel 34 and a toe 36 in a subterranean formation 40.

The downhole tool 100 can be at a first position 31 at a wellhead 18 near a surface 12. In some embodiments, a vehicle, such as a truck 10, can transport the coiled tubing 382 acting as the conveyor 380, as described above, coupled to the downhole tool 100 through a wellhead piping 18.

A panel 82 near the wellhead piping 18 can include one or more instruments 84, such as an interrogator 84, at the surface 12 to direct light into the waveguide 374, as hereinafter described, coupled to the downhole tool 100. An uphole end 376 of the waveguide 374 can be subsequently coupled to the interrogator 84.

Referring to FIG. 16, the coiled tubing 382 can be extended to deploy the downhole tool 100 past the heel 34 to a second position 37 at the toe 36. Thus, the downhole tool 100 can be at a second position 37 prior to activating the anchor assembly 160. After activation, the anchor assembly 160 can fix the downhole tool 100 at the toe 36, and hereinafter may be referred to as a first location 52 as depicted in FIG. 17.

In some embodiments, the waveguide 374 does not deploy during descent to the toe 36, but referring to FIG. 17, can be retracted by the coiled tubing 382 past the heel 34 to the surface 12 and then coupled to the instrument 84, after the anchor assembly 160 is activated by raising the fluid pressure with a pump, to a first pressure for securing the downhole tool 100. Correspondingly, the at least one flowmeter assembly 200 may be released, e.g., the actuator 170 of the anchor assembly 160 can remove the pin from the sleeve releasing the at least one flowmeter assembly 200 and the coil 360. Next, as the coiled tubing 382 retracts, the first flowmeter assembly 220, the second flowmeter assembly 300, and the coil 360 may be located at a second location 54 uphole of the first location 52. Once at the second location 54, the first flowmeter assembly 220 may be anchored by, e.g., raising the fluid pressure to a second pressure exceeding the first pressure in the fluid pathway 32 with a pump to activate the pressure activated release 260, as discussed above, to anchor the first flowmeter assembly 220 and withdraw the pin to release the second flowmeter 300 and the coil 360. That being done, the coil tubing 382 can be further retracted to place the second flowmeter assembly 300 and coil 360 at a third location 56 uphole from the second location 54. Once at the third location 56, the second flowmeter assembly 300 and coil 360 may be anchored by, e.g., raising the fluid pressure in the fluid pathway 32 to a third pressure exceeding the second pressure with a pump to activate the pressure activated release 260, as discussed above, to anchor the second flowmeter assembly 300 in the fluid flow pathway 32. Afterwards, the coil tubing 382 and the coil 360 can be withdrawn to the surface 12. Thus, the first and second flowmeter assemblies 220 and 300 can be located at different locations 50 in the fluid path 32. The waveguide 374 can remain in communication and transmit signals as well as the first and second flowmeter assemblies 220 and 300 to the panel 82. The waveguide 374 can be coupled to the interrogator 84 for pulsing light through the waveguide 374 for monitoring the first and second flowmeter assemblies 220 and 300.

In the subterranean formation 40, produced fluid may emanate from the formation fractures 42, and thus fluid may pass through the first and second flowmeter assemblies 220 and 300. As indicated by the up arrows, the production fluid, such as various hydrocarbon liquids and gases, and water, can flow upward to the surface 12, from hydrocarbon producing wells or geothermal wells, and be processed at the surface for products or disposal. Moreover, injection fluids, such as water, natural gas, enriched gas, or carbon dioxide, may be injected or introduced into the fluid pathway 32, as indicated by the down arrows.

Figure 18:
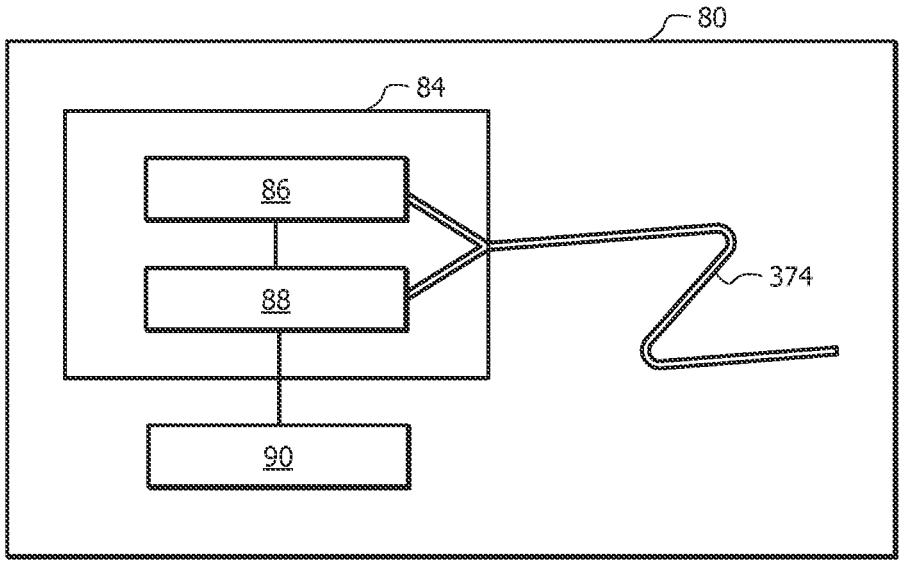
FIG. 18 illustrates a block diagram of an exemplary sensing system in accordance with any embodiment.

FIG. 18 illustrates a block diagram of an exemplary DAS system 80 in accordance with embodiments of the present disclosure. Embodiments of the present disclosure may employ a waveguide-based DAS system 80 to record signals, such as acoustic signals, generated by fluid flow associated with the presence of hydrocarbon reservoirs. In some embodiments, the DAS system 80 may be coupled to the waveguide 374 comprising a plurality of receiving sensors (e.g., acoustic and/or seismic sensors) such as fiber-optic sensors, geophones, optical hydrophones, accelerometers, fiber-optic interferometric sensors, and/or like to measure the acoustic data and the seismic data. Other types of fiber-optic sensors may include point sensors either at the surface and/or downhole. Single point or multi-point pressure and temperature sensors may be commonly used in reservoir monitoring applications, where the pressure sensors may be capable of collecting data at rates up to about 2,000 hertz (Hz) or even higher.

The fiber-optic sensing systems may operate using various sensing principles like Rayleigh scattering, Brillouin scattering, Raman scattering including but not limited to amplitude based sensing systems like, e.g., DTS systems based on Raman scattering, phase sensing based systems like, e.g., DAS systems based on interferometric sensing using, e.g., homodyne or heterodyne techniques where the system may sense phase or intensity changes due to constructive or destructive interference, strain sensing systems like DSS using dynamic strain measurements based on interferometric sensors or static strain sensing measurements using, e.g., Brillouin scattering, quasi-distributed sensors based on, e.g., Fiber Bragg Gratings (FBGs) where a wavelength shift is detected or multiple FBGs are used to form Fabry-Perot type interferometric sensors for phase or intensity based sensing, or single point fiber-optic sensors based on Fabry-Perot, FBG, or intensity based sensors.

True DFOS systems may operate based on, e.g., optical time domain reflectometry (OTDR) principles or optical frequency domain reflectometry (OFDR). OTDR based systems can be pulsed where one or more optical pulses may be transmitted down an optical fiber and backscattered light (Rayleigh, Brillouin, Raman, etc.) may be measured and processed. Time of flight for the optical pulse(s) can indicate where along the optical fiber the measurement is conducted. OFDR based systems operate in continuous wave (CW) mode where a tunable laser may be swept across a wavelength range, and the back scattered light can be collected and processed.

Various hybrid approaches where single point, quasi-distributed or distributed fiber-optic sensors are mixed with, e.g., electrical sensors, may also be used. The fiber-optic cable may then include optical fiber and electrical conductors. Electrical sensors may be pressure sensors based on quartz-type sensors or strain gauge based sensors or other commonly used sensing technologies. Pressure sensors, optical or electrical, may be housed in dedicated gauge mandrels or attached outside the casing in various configurations for downhole deployment or deployed conventionally at the surface well head or flow lines.

Temperature measurements from, e.g., a DTS system may be used to determine locations for water injection applications where fluid inflow in the treatment well as the fluids from the surface are likely to be cooler than formation temperatures. DTS warm-back analyses can be used to determine fluid volume placement and can often be conducted for water injection wells and the same technique can be used for fracturing fluid placement. Temperature measurements in observation wells can be used to determine fluid communication between the treatment well and observation well, or to determine formation fluid movement.

Fiber Bragg Grating based systems may also be used for a number of different measurements. FBG systems may be partial reflectors that can be used as temperature and strain sensors, or can be used to make various interferometric sensors with very high sensitivity. FBG systems can be used to make point sensors or quasi-distributed sensors where these FBG based sensors can be used independently or with other types of fiber-optic based sensors. FBG systems can be manufactured into an optical fiber at a specific wavelength, and other system like DAS, DSS or DTS systems may operate at different wavelengths in the same fiber and measure different parameters simultaneously as the FBG based systems using wavelength division multiplexing (WDM) and/or time division multiplexing (TDM).

The sensors can be placed in either the treatment well or monitoring well(s) to measure well communication. The treatment well pressure, rate, proppant concentration, diverters, fluids and chemicals may be altered to change the hydraulic fracturing treatment. These changes may impact the formation responses in several different ways, e.g.: stress fields may change, and this may generate microseismic effects that can be measured with DAS systems and/or single point seismic sensors like geophones; fracture growth rates may change and this can generate changes in measured microseismic events and event distributions over time, or changes in measured strain using the low frequency portion or the DAS signal or Brillouin based sensing systems; pressure changes due to poroelastic effects may be measured in the monitoring well; pressure data may be measured in the treatment well and correlated to formation responses; and various changes in treatment rates and pressure may generate events that can be correlated to fracture growth rates.

FIG. 18 shows a particular configuration of components of a sensing system 80, such as a DAS system 80. However, any suitable configurations of components may be used. The DAS system 80 may be inclusive of an interrogator unit 84 and the waveguide 374 coupled thereto.

While the DAS system 80 generally indicates a fiber-optic DAS system and the interrogator 84 show a light source 86 indicating a fiber-optic interrogator or a fiber-optic sensing system, a person skilled in the art understands that any combination of optical and/or electrical sensors, and electrical and/or optical interrogators fall within the scope of the present embodiments. In such implementations, the waveguide 374 may be attached to an electric sensor and an electrical interrogator to collect acoustic data comprising acoustic signals with a receiver 88.

Additionally, within the DAS system 80, the interrogator 84 including the receiver 88 may be connected to a processor 90 through connection, which may be wired and/or wireless. It should be noted that both processor 90 and the DAS system 80 may be disposed on a fixed platform. The processor 90 may be a part of the DAS system 80 or a separate processing unit disposed on a fixed platform.

Both systems and methods of the present disclosure may be implemented, at least in part, with processor 90. The processor 90 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The processor 90 may include random access memory (RAM), one or more processing resources such as a central processing unit (CPU) or hardware or software control logic, read-only memory (ROM), and/or other types of nonvolatile memory. Additional components of the processor 90 may include one or more disk drives, one or more network ports for communication with external devices as well as an input device (e.g., keyboard, mouse, etc.), and video display. The processor 90 may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, compact disc-read only memory (CD-ROM), digital versatile disc (DVD), RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

In some examples, the DAS system 80 may interrogate the waveguide 374 using coherent radiation and relies on interference effects to detect seismic disturbances on the waveguide 374. For example, a mechanical strain on a section of optical fiber can modify the optical path length for scattering sites on the waveguide 374, and the modified optical path length can vary the phase of the backscattered optical signal. The phase variation can cause interference among backscattered signals from multiple distinct sites along the length of the waveguide 374 and thus affect the intensity and/or phase of the optical signal detected by the DAS system 80. In some instances, the seismic disturbances on the waveguide 374 are detected by analysis of the intensity and/or phase variations in the backscattered signals.

The waveguide 374 and the flowmeters in the flowmeter assemblies 220 and 300, in, e.g., FIG. 1, can detect acoustic and other data that can be converted to flow data. The waveguide 374 can include a plurality of acoustic sensors to record acoustic signals. The DAS interrogator 84 may comprise the light source 86 (e.g., a laser) that is configured to emit a plurality of coherent light frequencies into the waveguide 374 and the receiver 88 to receive backscattered light from the plurality of receiving sensors of the waveguide 374.

In some embodiments, the interrogator 84 may be a part of a DAS system or any other electrical or optical interrogation unit, coupled with the waveguide 374 deployed in the fluid path 32 in, e.g., FIG. 17, and configured to continuously measure and record real-time acoustic signals from the fluid flow. Particularly in some embodiments, the DAS system may comprise one or more DAS interrogators 84 and waveguides 374. The DAS interrogator 84 may have an internal selection of fixed length waveguides 374 that are used to generate interference measurements out of the reflected signals returning from a waveguide 374 under measurement. Each of these waveguides 374 may be used as an option to adjust the gauge length. Accordingly, to the disclosed methods herein, the DAS interrogator 84 may employ a waveguide switch to select a desired length optical fiber among the optical fibers for adjusting the gauge length based on the interference measurements and placing the desired gauge length fiber in the measurement circuit. The fiber-optic switch may comprise a software-controlled microelectromechanical system (MEMS) device or any other suitable optical switch. Thus, the disclosed methods provide the DAS interrogator to continually switch among a set of gauge lengths in the DAS interrogator during the acquisition to enhance sensitivity and to optimize signal-to-noise ratio (SNR) in real-time.

In some embodiments, in a hydraulic fracturing environment, a hydraulic fracturing process may include pumping a treatment fluid into a wellbore at a known rate through perforations into a subterranean formation. The DAS system may measure data about strain signals generated by the treatment fluid moving through the formation. The methods described herein may employ real-time calculation of positions of the treatment fluid in the formation, which may be used to determine characteristics (e.g., a size and a location) of fractures formed during the hydraulic fracturing process. As an example, use of smaller gauge lengths may allow for more accurate interpretation of the signals (including the location and the size of the fractures and strain sources) when the fractures are close to the fiber and the signals are large. This provides an operator with real-time access to DAS measurements and the ability to adjust DAS system settings and fracturing parameters on the fly to account for varying signal conditions. In this way, employing dynamic gauge length adjustment may enable early signal detection results (e.g., analysis of fluid location) and provide more time for the treatment plan to react to a potential well hit while also potentially enabling monitoring of smaller sources such as production.

DAS data can be used to determine fluid allocation in real-time as acoustic noise is generated when fluid flows through the casing and in through perforations into the formation. Phase and intensity based interferometric sensing systems can be sensitive to temperature and mechanical as well as acoustically induced vibrations. DAS data can be converted from time series date to frequency domain data using Fast Fourier Transforms (FFT) and other transforms like wavelet transforms may also be used to generate different representations of the data. Various frequency ranges can be used for different purposes and where, e.g., low frequency signal changes may be attributed to formation strain changes or temperature changes due to fluid movement and other frequency ranges may be indicative of fluid or gas movement. Various filtering techniques and models may be applied to generate indicators of events that may be of interest. Indicators may include formation movement due to growing natural fractures, formation stress changes during the fracturing operations (also be called stress shadowing), fluid seepage during the fracturing operation as formation movement may force fluid into an observation well, fluid flow from fractures, and fluid and proppant flow from fracture hits. Each indicator may have a characteristic signature in terms of frequency content, amplitude and/or time dependent behavior. These indicators may also be present at other data types and not limited to DAS data. Fiber-optic cables used with DAS systems may include enhanced back scatter optical fibers where the Rayleigh backscatter may be increased by about 10 times or more with an associated increase in optical signal-to-noise ratio (OSNR).

DAS systems can also be used to detect various seismic events where stress fields and/or growing fracture networks generate microseimic events or where perforation charge events may be used to determine travel time between horizontal wells and this information can be used from stage-to-stage to determine changes in travel time as the formation is fractured and filled with fluid and proppant. The DAS systems may also be used with surface seismic sources to generate vertical seismic profiles (VSPs) before, during, and after a fracturing job to determine fracturing and production effectiveness. VSPs and reflection seismic surveys may be used over the life of a well and/or reservoir to track production related depletion and/or track, e.g., water, gas, and polymer flood fronts.

DSS data can be generated using various approaches and static strain data can be used to determine absolute strain changes over time. Static strain data is often measured using Brillouin based systems or quasi-distributed strain data from a FBG based system. Static strain may also be used to determine propped fracture volume by analyzing deviations in strain data from a measured strain baseline prior to fracturing. Other formation properties may be determined such as permeability, poroelastic responses, and leak-off rates based on the change of strain versus time and the rate at which the strain changes over time. Dynamic strain data can be used in real-time to detect fracture growth through an appropriate inversion model, and appropriate actions like dynamic changes to fluid flow rates in the treatment well, the addition of diverters or chemicals into the fracturing fluid, or changes to proppant concentrations or types can then be used to mitigate detrimental effects.

In some embodiments, the SNR optimization may include data-driven or machine learning type models for managing multiple sensing systems and data sets in different environments (e.g., regions, basins, reservoirs, layers, drilling info, etc.). The model may predict the DAS signals from an assumed set of hydraulic fractures or strain sources in the formation and use the results to optimize the fracturing parameters. The model may be a machine learning model, a data-driven model, a physics-based model, or a hybrid model.

Several measurements can be combined to determine distributed flow in subsurface wells. Multiple wells in a field and/or reservoir may be instrumented with optical fibers for monitoring subsurface reservoirs from initial operation to operation cessation. Subsurface applications may include hydrocarbon extraction, geothermal energy production and/or fluid injection such as water or carbon dioxide in a carbon capture, utilization, and storage application.

In any embodiment, the downhole tool 100, particularly the coil 360 and the at least one flowmeter assembly 200 can include a dissolvable metal or resin. In any embodiment, for example, the first flowmeter assembly 220 can be made of a metal or resin dissolvable with a preselected fluid solvent comprising an acid, after the flowmeter assembly 220 is deployed in the fluid path 32. After service, the preselected fluid solvent can be introduced downhole to dissolve the downhole tool 100, particularly the anchor assembly 160, the at least one flowmeter assembly 200 and the coil 360.

Additional Disclosure

The following are non-limiting, specific embodiments in accordance with the present disclosure:

A first embodiment, which is a downhole tool having a downhole end and an uphole end, comprising an anchor assembly positioned proximate to the downhole end; at least one flowmeter assembly selectively positionable from the downhole tool wherein the at least one flowmeter assembly comprises a flowmeter having a throughbore generally aligned with an axis of the flowmeter; and a waveguide positioned proximate to the uphole end, wherein the at least one flowmeter assembly is positioned proximate to the anchor, wherein the waveguide extends through the throughbore and is secured at the anchor assembly.

A second embodiment, which is the downhole tool of the first embodiment, wherein the at least one flowmeter assembly comprises an inner cylinder disposed within an outer housing wherein the inner cylinder comprises one or more fluidic oscillators formed on an outer surface.

A third embodiment, which is the downhole tool of any of the first and the second embodiments, wherein the at least one flowmeter assembly further comprises a seal insertable into the outer housing and coupled to the anchor assembly.

A fourth embodiment, which is the downhole tool of any of the first through third embodiments, wherein the at least one flowmeter assembly further comprises a pressure activated release.

A fifth embodiment, which is the downhole tool of any of the first through fourth embodiments, wherein the pressure activated release comprises a housing, and a first burst disc and a second burst disc operable at different pressures and forming different portions of the housing, and a spring biased piston at least partially within the housing coupled to an anchor.

A sixth embodiment, which is the downhole tool of any of the first through fifth embodiments, further comprising a plurality of flowmeter assemblies comprising a first flowmeter assembly and a second flowmeter assembly wherein the first flowmeter assembly positioned adjacent to the anchor assembly and the second flowmeter assembly uphole of the first flowmeter assembly, wherein the first and second flowmeter assemblies are independently positionable at different locations in a wellbore.

A seventh embodiment, which is the downhole tool of any of the first through sixth embodiments, further comprising a third flowmeter assembly uphole of the second flowmeter assembly and independently retractable from the anchor assembly and retractable at a different location than the first and second flowmeter assemblies.

An eighth embodiment, which is the downhole tool of any of the first through seventh embodiments, further comprising a coil adjacent to the at least one flowmeter assembly and a conveyor adjacent to the coil.

A ninth embodiment, which is the downhole tool of any of the first through eighth embodiments, wherein the conveyor comprises a coiled tubing, a cable, a wireline, a tractor, or a combination thereof.

A tenth embodiment, which is the downhole tool of any of the first through ninth embodiments, wherein the waveguide comprises a fiber-optic cable.

An eleventh embodiment, which is the downhole tool of any of the first through tenth embodiments, wherein the anchor assembly comprises a swellable packer or an actuator comprising an anchor.

A twelfth embodiment, which is the downhole tool of any of the first through eleventh embodiments, wherein the at least one flowmeter assembly comprises a pressure activated release comprising an anchor.

A thirteenth embodiment, which is the downhole tool of any of the first through twelfth embodiments, wherein the at least one flowmeter assembly comprises a plurality of flowmeter assemblies comprising first and second flowmeters, each flowmeter having a respective throughbore coaxial with a central axis of the respective flowmeter for receiving the fiber-optic cable.

A fourteenth embodiment, which is the downhole tool of any of the first through thirteenth embodiments, wherein the waveguide is configured to sense an acoustic signal, a temperature signal, a pressure signal, or combinations thereof and communicate the signal to a processor for analysis.

A fifteenth embodiment, which is the downhole tool of any of the first through fourteenth embodiments, wherein the downhole tool comprises a metal or a resin dissolvable with a preselected fluid solvent.

A sixteenth embodiment, which is the downhole tool of any of the first through fifteenth embodiments, wherein the at least one flowmeter assembly and a coil comprises a metal or resin dissolvable with a preselected fluid solvent comprising an acid.

A seventeenth embodiment, which is a downhole system for detecting features in a wellbore, comprising a downhole tool having a downhole end and an uphole end, the downhole tool comprising an anchor assembly adjacent to the downhole end; a plurality of flowmeter assemblies comprising a first flowmeter assembly adjacent to the anchor assembly and a second flowmeter assembly uphole of the first flowmeter assembly wherein the first and second flowmeter assemblies are independently detachable from the downhole tool and deployable at different locations in a wellbore and each of the first and second flowmeter assemblies comprising a respective first and second flowmeters having a throughbore generally aligned with an axis of the flowmeter; a coil comprising a waveguide uphole of the plurality of flowmeter assemblies, wherein the waveguide is secured at the anchor assembly and is extended within and past the respective throughbore of the first and second flowmeters; an instrument comprising an interrogator for directing light into the waveguide; and a conveyor adjacent to the coil for retracting the plurality of flowmeter assemblies.

An eighteenth embodiment, which is the downhole system of the seventeenth embodiment, further comprising a third flowmeter assembly uphole of the second flowmeter assembly and independently detachable from the downhole tool and deployable at a different location than the first and second flowmeter assemblies.

A nineteenth embodiment, which is the downhole system of any of the seventeenth through eighteenth embodiments, wherein the plurality of flowmeter assemblies comprises respective flowmeters, each flowmeter comprising an inner cylinder disposed within an outer housing wherein the inner cylinder comprises one or more fluidic oscillators formed on an outer surface and the throughbore is coaxial with a central axis of the respective flowmeter.

A twentieth embodiment, which is the downhole system of any of the seventeenth through nineteenth embodiments, wherein each of the flowmeters of the plurality of flowmeter assemblies further comprises a seal insertable into the outer housing and coupled to the anchor assembly.

A twenty-first embodiment, which is the downhole system of any of the seventeenth through twentieth embodiments, wherein each of the flowmeters of the plurality of flowmeter assemblies further comprises a respective pressure activated release.

A twenty-second embodiment, which is the downhole system of any of the seventeenth through twenty-first embodiments, wherein each of the respective pressure activated releases comprises a housing, and a first burst disc and a second burst disc operable at different pressures and forming different portions of the housing, and a spring biased piston at least partially within the housing.

A twenty-third embodiment, which is the downhole system of any of the seventeenth through twenty-second embodiments, wherein the waveguide comprises a fiber-optic cable.

A twenty-fourth embodiment, which is the downhole system of any of the seventeenth through twenty-third embodiments, wherein the fiber-optic cable is coupled to the anchor assembly and has an uphole end retractable to the instrument.

A twenty-fifth embodiment, which is the downhole system of any of the seventeenth through twenty-fourth embodiments, wherein the fiber-optic cable is configured to sense an acoustic signal, a temperature signal, a pressure signal, or combinations thereof and communicate the signal to a processor for analysis.

A twenty-sixth embodiment, which is the downhole system of any of the seventeenth through twenty-fifth embodiments, wherein the conveyor comprises a coiled tubing, a cable, a wireline, a tractor, or a combination thereof.

A twenty-seventh embodiment, which is the downhole system of any of the seventeenth through twenty-sixth embodiments, wherein the waveguide is positioned adjacent to the uphole end, and the waveguide extends through the throughbore of respective flowmeters and is secured at the anchor assembly.

A twenty-eighth embodiment, which is the downhole system of any of the seventeenth through twenty-seventh embodiments, wherein the downhole tool comprises a metal or a resin dissolvable with a preselected fluid solvent.

A twenty-ninth embodiment, which is the downhole system of any of the seventeenth through twenty-eighth embodiments, wherein the at least one flowmeter assembly and a coil comprises a metal or resin dissolvable with a preselected fluid solvent comprising an acid.

A thirtieth embodiment, which is a method of deploying a downhole tool having a downhole end and an uphole end, comprising positioning the downhole tool within a subterranean formation; wherein the downhole tool comprises an anchor assembly adjacent to the downhole end; and a first flowmeter assembly adjacent to the anchor assembly and a second flowmeter assembly uphole of the first flowmeter assembly wherein each of the first and second flowmeters comprise a respective first flowmeter and second flowmeter having a throughbore generally aligned with an axis of the respective flowmeter; and a coil comprising a waveguide at an uphole end, wherein the waveguide is secured at the anchor assembly and extends from the coil through the respective throughbore of the first and second flowmeters, and is secured at the anchor assembly; retracting the coil along with the first flowmeter assembly and the second flowmeter assembly during positioning; establishing a pressure for positioning the first flowmeter assembly at a first location and another pressure for positioning the second flowmeter assembly at a second location along a fluid path; and retrieving an uphole end of the waveguide from the downhole tool to an instrument for establishing communication.

A thirty-first embodiment, which is the method of the thirtieth embodiment, further comprising providing a third flowmeter assembly uphole of the second flowmeter assembly and independently detachable from the downhole tool and deployable at a different location than the first and second flowmeter assemblies and establishing yet another pressure for positioning the third flowmeter assembly at a third location along the fluid path.

A thirty-second embodiment, which is the method of any of the thirtieth through thirty-first embodiments, wherein the first flowmeter assembly is positioned uphole of the anchor assembly, the second flowmeter assembly is positioned uphole of the first flowmeter assembly, and the third flowmeter assembly is positioned uphole of the second flowmeter assembly in the fluid path.

A thirty-third embodiment, which is the method of any of the thirtieth through thirty-second embodiments, wherein the plurality of flowmeter assemblies comprises respective flowmeters, each flowmeter comprising an inner cylinder disposed within an outer housing wherein the inner cylinder comprises one or more fluidic oscillators formed on an outer surface and the throughbore is coaxial with a central axis of the respective flowmeter.

A thirty-fourth embodiment, which is the method of any of the thirtieth through thirty-third embodiments, wherein each of the flowmeters of the plurality of flowmeter assemblies further comprises a seal insertable into the outer housing.

A thirty-fifth embodiment, which is the method of any of the thirtieth through thirty-fourth embodiments, wherein each of the flowmeters of the plurality of flowmeter assemblies further comprises a pressure activated release.

A thirty-sixth embodiment, which is the method of any of the thirtieth through thirty-fifth embodiments, wherein each of the pressure activated releases comprises a housing, and a first burst disc and a second burst disc operable at different pressures and forming different portions of the housing, and a spring biased piston at least partially within the housing coupled to an anchor.

A thirty-seventh embodiment, which is the method of any of the thirtieth through thirty-sixth embodiments, further comprising providing a conveyor comprising a coiled tubing, a cable, a wireline, a tractor, or a combination thereof.

A thirty-eighth embodiment, which is the method of any of the thirtieth through thirty-seventh embodiments, wherein retrieving an uphole end of the waveguide comprises retracting a coiled tubing, or activating a tractor or a retrieving a wire comprised in a conveyor for retracting the uphole end of the waveguide to the surface.

A thirty-ninth embodiment, which is the method of any of the thirtieth through thirty-eighth embodiments, further comprising anchoring the first flowmeter assembly at a further pressure and anchoring the second flowmeter assembly at yet a further pressure.

A fortieth embodiment, which is the method of any of the thirtieth through thirty-ninth embodiments, further comprising anchoring the third flowmeter assembly at another further pressure.

A forty-first embodiment, which is the method of any of the thirtieth through fortieth embodiments, wherein the waveguide comprises a fiber-optic cable detecting oscillation signals from the one or more fluidic oscillators and conveying the signals to the surface.

A forty-second embodiment, which is the method of any of the thirtieth through forty-first embodiments, wherein the downhole tool comprises a dissolvable metal or resin, and further comprising introducing a preselected fluid solvent downhole to dissolve the downhole tool.

A forty-third embodiment, which is the method of any of the thirtieth through forty-second embodiments, wherein the coil and the first and second flowmeter assemblies comprise a dissolvable metal or resin, and further comprising introducing a preselected fluid solvent downhole to dissolve the first and second flowmeter assemblies.

A forty-fourth embodiment, which is the method of any of the thirtieth through forty-third embodiments, further comprising interrogating the waveguide for collecting acoustic signals through the waveguide and signals from each of the first and second flow meter assemblies, and converting the signals to multiphase fluid flow data.

A forty-fifth embodiment, which is the method of any of the thirtieth through forty-fourth embodiments, further comprising interrogating one or more optical pulses through the waveguide, measuring time of flight of the optical pulses from the first flowmeter assembly and the second flowmeter assembly, and differentiating by time of flight the signals to generate the multiphase fluid flow data for displaying on a screen for an operator.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A downhole tool having a downhole end and an uphole end, comprising:

an anchor assembly positioned proximate to the downhole end;

at least one flowmeter assembly selectively positionable from the downhole tool wherein the at least one flowmeter assembly comprises a flowmeter having a throughbore generally aligned with an axis of the flowmeter;

a coil of waveguide positioned proximate to the uphole end adjacent to the at least one flowmeter assembly, wherein the at least one flowmeter assembly is positioned proximate to the anchor, wherein the waveguide extends through the throughbore and is secured at the anchor assembly; and a conveyor adjacent to the coil.

2. The downhole tool of claim 1, wherein the at least one flowmeter assembly comprises an inner cylinder disposed within an outer housing wherein the inner cylinder comprises one or more fluidic oscillators formed on an outer surface.

3. The downhole tool of claim 2, wherein the at least one flowmeter assembly further comprises a pressure activated release.

4. The downhole tool of claim 3, wherein the pressure activated release comprises a housing, and a first burst disc and a second burst disc operable at different pressures and forming different portions of the housing, and a spring biased piston at least partially within the housing coupled to an anchor.

5. The downhole tool of claim 1, further comprising a plurality of flowmeter assemblies comprising a first flowmeter assembly and a second flowmeter assembly wherein the first flowmeter assembly positioned adjacent to the anchor assembly and the second flowmeter assembly uphole of the first flowmeter assembly, wherein the first and second flowmeter assemblies are independently positionable at different locations in a wellbore.

6. The downhole tool of claim 5, further comprising a third flowmeter assembly uphole of the second flowmeter assembly and independently retractable from the anchor assembly and retractable at a different location than the first and second flowmeter assemblies.

7. The downhole tool of claim 1, wherein the conveyor comprises a coiled tubing, a cable, a wireline, a tractor, or a combination thereof.

8. The downhole tool of claim 1, wherein the waveguide comprises a fiber-optic cable.

9. The downhole tool of claim 8, wherein the at least one flowmeter assembly comprises a plurality of flowmeter assemblies comprising first and second flowmeters, each flowmeter having a respective throughbore coaxial with a central axis of the respective flowmeter for receiving the fiber-optic cable.

10. The downhole tool of claim 1, wherein the anchor assembly comprises a swellable packer or an actuator comprising an anchor.

11. The downhole tool of claim 1, wherein the at least one flowmeter assembly comprises a pressure activated release comprising an anchor.

12. The downhole tool of claim 1, wherein the waveguide is configured to sense an acoustic signal, a temperature signal, a pressure signal, or combinations thereof and communicate the signal to a processor for analysis.

13. The downhole tool of claim 1, wherein the downhole tool comprises a metal or a resin dissolvable with a preselected fluid solvent.

14. A method of deploying a downhole tool having a downhole end and an uphole end, comprising:

positioning the downhole tool within a subterranean formation; wherein the downhole tool comprises:

an anchor assembly proximate to the downhole end; and a first flowmeter assembly proximate to the anchor assembly and a second flowmeter assembly uphole of the first flowmeter assembly wherein each of the first and second flowmeters comprise a respective first flowmeter and second flowmeter having a throughbore generally aligned with an axis of the respective flowmeter; and a coil comprising a waveguide at an uphole end, wherein the waveguide is secured at the anchor assembly and extends from the coil through the respective throughbore of the first and second flowmeters, and is secured at the anchor assembly;

retracting the coil along with the first flowmeter assembly and the second flowmeter assembly during positioning;

establishing a pressure for positioning the first flowmeter assembly at a first location and another pressure for positioning the second flowmeter assembly at a second location along a fluid path;

retrieving an uphole end of the waveguide from the downhole tool to an instrument for establishing communication.

15. The method of claim 14, further comprising providing a third flowmeter assembly uphole of the second flowmeter assembly and independently detachable from the downhole tool and deployable at a different location than the first and second flowmeter assemblies and establishing yet another pressure for positioning the third flowmeter assembly at a third location along the fluid path.

16. The method of claim 15, wherein the first flowmeter assembly is positioned uphole of the anchor assembly, the second flowmeter assembly is positioned uphole of the first flowmeter assembly, and the third flowmeter assembly is positioned uphole of the second flowmeter assembly in the fluid path.

17. The method of claim 14, further comprising interrogating the waveguide for collecting acoustic signals through the waveguide and signals from each of the first and second flowmeter assemblies, and converting the signals to multiphase fluid flow data.

18. The method of claim 17, further comprising interrogating one or more optical pulses through the waveguide, measuring time of flight of the optical pulses from the first flowmeter assembly and the second flowmeter assembly, and differentiating by time of flight the signals to generate the multiphase fluid flow data for displaying on a screen for an operator.

19. A downhole system for detecting features in a wellbore, comprising:

a downhole tool having a downhole end and an uphole end, the downhole tool comprising:

an anchor assembly proximate to the downhole end;

a plurality of flowmeter assemblies comprising a first flowmeter assembly proximate to the anchor assembly and a second flowmeter assembly uphole of the first flowmeter assembly wherein the first and second flowmeter assemblies are independently detachable from the downhole tool and deployable at different locations in a wellbore and each of the first and second flowmeter assemblies comprising a respective first and second flowmeters having a throughbore generally aligned with an axis of the flowmeter;

a coil comprising a waveguide uphole of the plurality of flowmeter assemblies, wherein the waveguide is secured at the anchor assembly and is extended within and past the respective throughbore of the first and second flowmeters;

an instrument comprising an interrogator for directing light into the waveguide; and a conveyor proximate to the coil for retracting the plurality of flowmeter assemblies.

20. A downhole tool having a downhole end and an uphole end, comprising:

an anchor assembly positioned proximate to the downhole end;

at least one flowmeter assembly selectively positionable from the downhole tool wherein the at least one flowmeter assembly comprises a flowmeter having a throughbore generally aligned with an axis of the flowmeter; and a waveguide positioned proximate to the uphole end, wherein the at least one flowmeter assembly is positioned proximate to the anchor, wherein the waveguide extends through the throughbore and is secured at the anchor assembly, wherein the at least one flowmeter assembly comprises an inner cylinder disposed within an outer housing wherein the inner cylinder comprises one or more fluidic oscillators formed on an outer surface and wherein the at least one flowmeter assembly further comprises a pressure activated release.

21. The downhole tool of claim 20, wherein the pressure activated release comprises a housing, and a first burst disc and a second burst disc operable at different pressures and forming different portions of the housing, and a spring biased piston at least partially within the housing coupled to an anchor.

22. A downhole tool having a downhole end and an uphole end, comprising:

an anchor assembly positioned proximate to the downhole end;

at least one flowmeter assembly selectively positionable from the downhole tool wherein the at least one flowmeter assembly comprises a flowmeter having a throughbore generally aligned with an axis of the flowmeter; and a waveguide positioned proximate to the uphole end, wherein the at least one flowmeter assembly is positioned proximate to the anchor, wherein the waveguide extends through the throughbore and is secured at the anchor assembly, wherein the at least one flowmeter assembly comprises a pressure activated release comprising an anchor.

* * * * *